US006825862B2

(12) United States Patent
Tokunaga

(10) Patent No.: US 6,825,862 B2
(45) Date of Patent: Nov. 30, 2004

(54) IMAGE FORMATION APPARATUS, IMAGE FORMATION METHOD, AND COMPUTER PRODUCT

(75) Inventor: Atsuo Tokunaga, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/351,481

(22) Filed: Jan. 27, 2003

(65) Prior Publication Data

US 2004/0021760 A1 Feb. 5, 2004

(30) Foreign Application Priority Data

Jan. 25, 2002 (JP) ..... 2002-017485
Jan. 23, 2003 (JP) ..... 2003-015079

(51) Int. Cl.[7] ..... B41J 2/385; G03G 15/04
(52) U.S. Cl. ..... 347/116; 347/238
(58) Field of Search ..... 347/115, 116, 347/117, 118, 130, 238, 232; 399/31, 32, 50, 51, 54, 53, 178, 223, 300, 46, 38

(56) References Cited

U.S. PATENT DOCUMENTS 4,791,452 A * 12/1988 Kasai et al. ..... 399/40
4,837,600 A * 6/1989 Kasai et al. ..... 399/40
5,557,394 A * 9/1996 Haneda et al. ..... 399/41
5,673,187 A 9/1997 Tokunaga et al.
5,752,137 A * 5/1998 Haneda ..... 399/223
5,881,339 A 3/1999 Yanagida et al.
5,930,002 A * 7/1999 Haneda et al. ..... 358/300
5,946,017 A * 8/1999 Carley ..... 347/115
5,970,282 A 10/1999 Yanagida et al.
6,072,703 A 6/2000 Tokunaga
6,191,801 B1 * 2/2001 Hiraoka et al. ..... 347/116
6,249,305 B1 * 6/2001 Miyamoto et al. ..... 347/232
6,487,376 B1 * 11/2002 Wang et al. ..... 399/12
6,532,029 B1 * 3/2003 Lee ..... 347/116

* cited by examiner

*Primary Examiner*—Daniel J. Colilla
*Assistant Examiner*—Leo T. Hinze
(74) *Attorney, Agent, or Firm*—Oblon, Spivak, McClelland, Maier & Neustadt, P.C.

(57) ABSTRACT

At least two image formation devices are provided. Each image formation device has a writing optical device that forms a latent image on a photosensitive member and a developing device that develops the latent image into a visual image. If the writing optical device in one of the two image formation devices is broken down, then the latent image is formed using the writing optical device in other of the two image formation devices. The latent image is developed to obtain the visual image using the developing device of the image formation device with the broken writing optical device.

24 Claims, 14 Drawing Sheets

IMAGE FORMATION APPARATUS, IMAGE FORMATION METHOD, AND COMPUTER PRODUCT

BACKGROUND OF THE INVENTION

1) Field of the Invention

The present invention relates to an image formation apparatus that has a plurality of writing optical units.

2) Description of the Related Art

Recently, the trend is that the image formation apparatuses such as copying machines and printers output color images. Moreover, there is a great demand for small sized and high speed image formation apparatus. An image formed by a color copying machine that employs a electrostatic copying system is formed by combining color toners of Y (yellow), M (magenta), C (cyan), Bk (black), or the like. According to the color copying machine, the significant characteristic of the color electrostatic copying system depends on whether the image formation with the colors is executed by the time series process or the concurrent process.

As to the discussion on the upper limit of the output number (for example, the number of outputs in copying or printing papers of a predetermined size in a unit time) among the performances of the image formation apparatus, it is known that the concurrent process system provides a value higher than that of the time series process. That is, although an image formation apparatus with a small size and low cost concurrent processing system mounted is required in the market, since a plurality of latent images should be processed at the same time in the image formation apparatus of the concurrent processing system, it is necessary to provide an image formation section including a writing optical device in the same number as that of the concurrent processes for forming the latent image.

However, according to the concurrent processing system, not all the image formation sections are operated at the time of all the image formations. For example, when a monochrome image is formed, only a section controlling the Bk image formation is operated without the need of the other image formation sections. Moreover, according to the concurrent processing system, when a writing optical device has failed or broken down (hereinafter "broken down"), a printing operation cannot be executed until the writing optical device is repaired even in the case of printing a single color image so as to require a pause period of the image formation apparatus. Furthermore, for example, according to a two color image formation apparatus with monochrome and another color functions, due to the limitation of the structure, or the like, the equivalent writing performance may not be provided to both of the image formation sections.

SUMMARY OF THE INVENTION

It is an object of this invention to at least solve the problems in the conventional technology.

The image formation apparatus according to one aspect of the present invention comprises a photosensitive member; a charging device that charges the photosensitive member; a charge eliminating device that eliminates a residual charge from the photosensitive member before the charging device charges the photosensitive member; and a first image formation section and a second image formation section each of the first image formation section and the second image formation section having a writing optical device that forms a latent image on a surface of the photosensitive member, and a developing device that forms a visual image by adhering a developing agent on the latent image. In this construction, a latent image formed by the writing optical device of the first image formation section is processed to be a visual image by the developing device of the second image formation section.

The image formation apparatus according to another aspect of the present invention comprises a photosensitive member; a charging device that charges the photosensitive member; a charge eliminating device that eliminates a residual charge from the photosensitive member before the charging device charges the photosensitive member; and a first image formation section and a second image formation section each of the first image formation section and the second image formation section having a writing optical device that forms a latent image on a surface of the photosensitive member, and a developing device that forms a visual image by adhering a developing agent on the latent image. In this construction, a first latent image of a first set of pixels is formed by the writing optical device of the first image formation section in a main scanning direction, a second latent image of a second set of pixels is formed between the pixels of the first set of pixels by the writing optical device of the second image formation section, and a visual image of the first latent image and the second latent image is formed by the developing device provided in any one of the first image formation section and the second image formation section.

The image formation apparatus according to still another aspect of the present invention comprises a photosensitive member; a charging device that charges the photosensitive member; a charge eliminating device that eliminates a residual charge from the photosensitive member before the charging device charges the photosensitive member; and a first image formation section and a second image formation section each of the first image formation section and the second image formation section having a writing optical device that forms a latent image on a surface of the photosensitive member, and a developing device that forms a visual image by adhering a developing agent on the latent image. In this construction, a latent image of different pixels lines in a main scanning direction is formed at different positions in a sub scanning direction by the writing optical devices of each of the first image formation section and the second image formation section on a surface of the photosensitive member, and a visual image of the latent images is formed by the developing device provided in any one of the first image formation section and the second image formation section.

The image formation method according to still another aspect of the present invention is a method of forming an image by an image formation apparatus, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image. The method comprises forming a latent image by the writing optical device of the first image formation sections; and forming a visual image of the latent image by the developing device of the second image formation section.

The image formation method according to still another aspect of the present invention is a method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image. The method comprises judging whether the writing optical device in the first image formation section is broken down; forming the latent image by the writing optical device of the second image formation section when it is judged that in the first image formation section is broken down; and forming the visual image of the latent image by the developing device of the first image formation section.

The image formation method according to still another aspect of the present invention is a method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image, wherein a gradation expressing ability of the writing optical device of the first image formation section is lower than a gradation expressing ability of the writing optical device of the second image formation section. The method comprises forming the latent image by the writing optical device of the second image formation section; and forming the visual image of the latent image by the developing device of the first image formation section.

The image formation method according to still another aspect of the present invention is a method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image. The method comprising forming a first latent image of a first set of pixels by the writing optical device of the first image formation section in a main scanning direction; forming a second latent image of a second set of pixels between the pixels of the first set of pixels by the writing optical device of the second image formation section; and forming a visual image of the first latent image and the second latent image by the developing device provided in any one of the first image formation section and the second image formation section.

The image formation method according to still another aspect of the present invention is a method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image. The method comprising forming a latent image of different pixels lines in a main scanning direction at different positions in a sub scanning direction by the writing optical devices of each of the first image formation section and the second image formation section on a surface of the photosensitive member; and forming a visual image of the latent images by the developing device provided in any one of the first image formation section and the second image formation section.

The computer program according to still another aspect of the present invention realizes the image formation method on an image formation apparatus.

These and other objects, features and advantages of the present invention are specifically set forth in or will become apparent from the following detailed descriptions of the invention when read in conjunction with the accompanying drawings.

DETAILED DESCRIPTION

Exemplary embodiments of the present invention are explained in detail below with reference to the accompanying drawings. The present invention is not limited by the embodiments. In the constituent elements in the following embodiments, those easily expected by a person in the art or those substantially equivalent are included.

Figure 1:
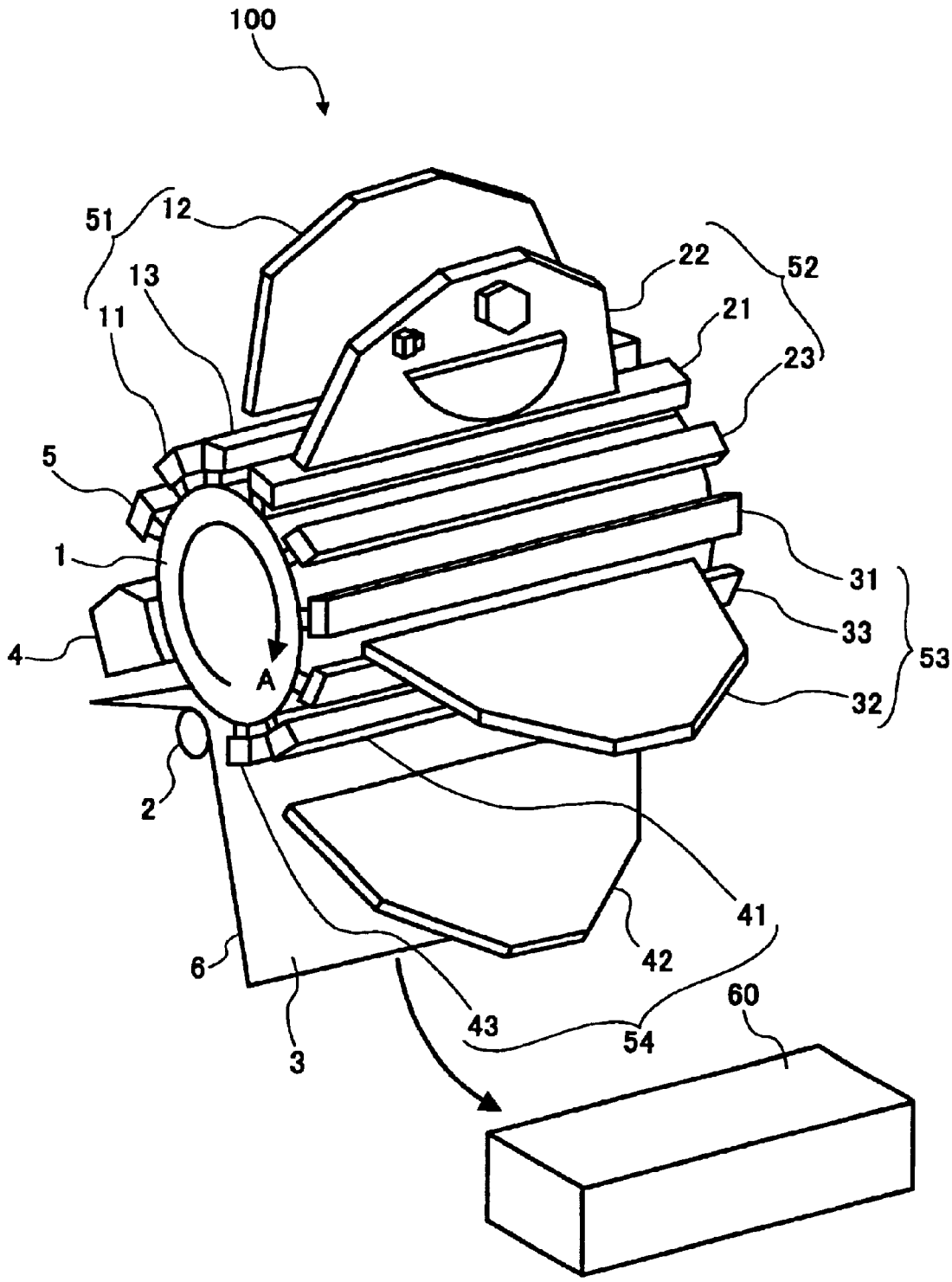
FIG. 1 is a perspective view that shows an image formation apparatus according to a first embodiment of the present invention.

FIG. 1 is a perspective view that shows an image formation apparatus 100 according to a first embodiment of the present invention. The image formation apparatus 100 comprises a plurality of image formation sections each having a writing optical device and a developing device. A characteristic feature of the image formation apparatus 100 is that a latent image to be formed by one writing optical device is formed by an another writing optical devices when a predetermined condition is satisfied, and the latent image is developed by a developing device.

A photosensitive drum 1, which is a photosensitive member, is rotated in the direction shown by an arrow A. A first image formation section 51 is arranged along a circumference of a surface of the photosensitive drum 1 on which an image is formed. The first image formation section 51 includes a first charging device 11, a first writing optical device 12, and a first developing device 13 disposed successively along the direction in which the photosensitive drum 1 rotates. Moreover, a second image formation section 52 is arranged on a downstream side of the first developing device 13. The second image formation section 52 includes a second charging device 21, a second writing optical device 22, and a second developing device 23 disposed successively. A third image formation section 53 is arranged on a downstream side of the second developing device 23. The third image formation section 53 includes a third charging device 31, a third writing optical device 32 and a third developing device 33 disposed successively. A fourth image formation section 54 is arranged on a downstream side of the third developing device 33. The fourth image formation section 54 includes a fourth charging device 41, a fourth writing optical device 42, and a fourth developing device 43 disposed successively. Moreover, a transfer device 2, a cleaning device 4, and a charge eliminating device 5 are disposed successively on a downstream of the fourth developing device 43. The term "downstream side" refers to a direction same as the direction of rotation of the photosensitive drum 1, and the downstream side in the sub scanning direction. Furthermore, the term "upstream side" refers to a direction that is opposite to the direction of rotation of the photosensitive drum 1, and the upstream side in the sub scanning direction.

It is preferable that the non-contact method is adopted with respect to the surface to have an image formed in the charging devices 11 to 41 and the developing devices 13 to 43 except the first charging device 11 and the developing device 13. For example, the case of having an image formed in the upstream side and further forming an image on the downstream side in the same area of the existing image is considered. In this case, when a contact type charging roller, or the like is adopted in the charging device 21, or the like, when the charging roller is placed on the image formed on the upstream side, not only the image formed on the upstream side is disturbed but also the roller pollution is generated in the charging roller itself due to image transfer.

Similarly, also in the developing device 23, or the like, when a two component developing device, or the like is adopted, a carrier is contacted onto the image like a reed screen (like a brush). Not only the image is disturbed but also image particles (toner) are mixed in the developing device so as to lead to color mixture or deterioration of the developing performance when the particle colors or components are different. However, according to an image processing device without generation of the problems by skillfully modifying the image formation process, for example, by preventing contact in the area with the upstream image existing according to a contacting and separating mechanism in a contact type method, or by inverting the potential polarity of the latent image or the developing toner in a contact method, it is not necessary to adopt a non-contact method.

Although the transfer device 2 may be either of a contact type or a non-contact type, a roller contact type transfer device is used in the first embodiment. According to a roller contact type transfer device, in order to separate a material to be transferred from the surface to have an image formed, the electrostatic suction force between the material to be transferred and the surface to have an image formed is reduced by a charge eliminating needle, or the like. The image transferred on the material to be transferred by the transfer device is fixed onto the material to be transferred by a fixing device 60.

Moreover, there are those adopting a transfer belt method in the contact type devices, and such a transfer device can be used as the transfer device of the present invention. Since a transfer belt provides a stable conveying force by electrostatic suction of the material to be transferred to the belt, it is preferable. There are those for transfer onto a member to be recorded by, for example, adding a corotron for transfer in a corotron for separation, and such a transfer device can be used as the transfer device of the present invention as well.

According to the configuration, the case of forming an image by the first to fourth image formation sections 51 to 54 is explained. When they are a full color image formation apparatus, for example, the first, second, third, and fourth image formation sections 51 to 54 each form C, M, Y, and Bk images.

In one rotation of the photosensitive drum 1, first, a first image is formed on the surface to have an image formed of the photosensitive drum 1 by the first charging device 11, the first writing optical device 12, and the first developing device 13 in the first image formation section 51. In a next rotation, a second image is formed on the surface to have an image formed of the photosensitive drum 1 by the second charging device 21, the second writing optical device 22 and the second developing device 23 in the second image formation section 52. Similarly, a third image and a fourth image are formed on the surface to have an image formed on the photosensitive drum 1 in the third image formation section 53 and the fourth image formation section 54 so that the first to fourth images are formed on the surface to have an image formed while four rotations of the photosensitive drum 1. Then, the first to fourth images formed are transferred on the surface to be transferred 3 of a paper, an over-head projector (OHP) sheet or another medium to be recorded 6 by the transfer device 6.

The medium to be recorded 3 with the first to fourth images transferred has the visual images transferred on the surface to have an image transferred 3 fixed by a fixing device 60 so that an image is formed on the medium to be recorded 3. As to the surface to have an image formed of the photosensitive drum 1 after the transfer, the residual image forming material on the surface to have an image formed is eliminated by the cleaning device 4, and then the residual potential is eliminated by the charge eliminating device 5.

SWITCHING EXAMPLE 1

Figure 2:
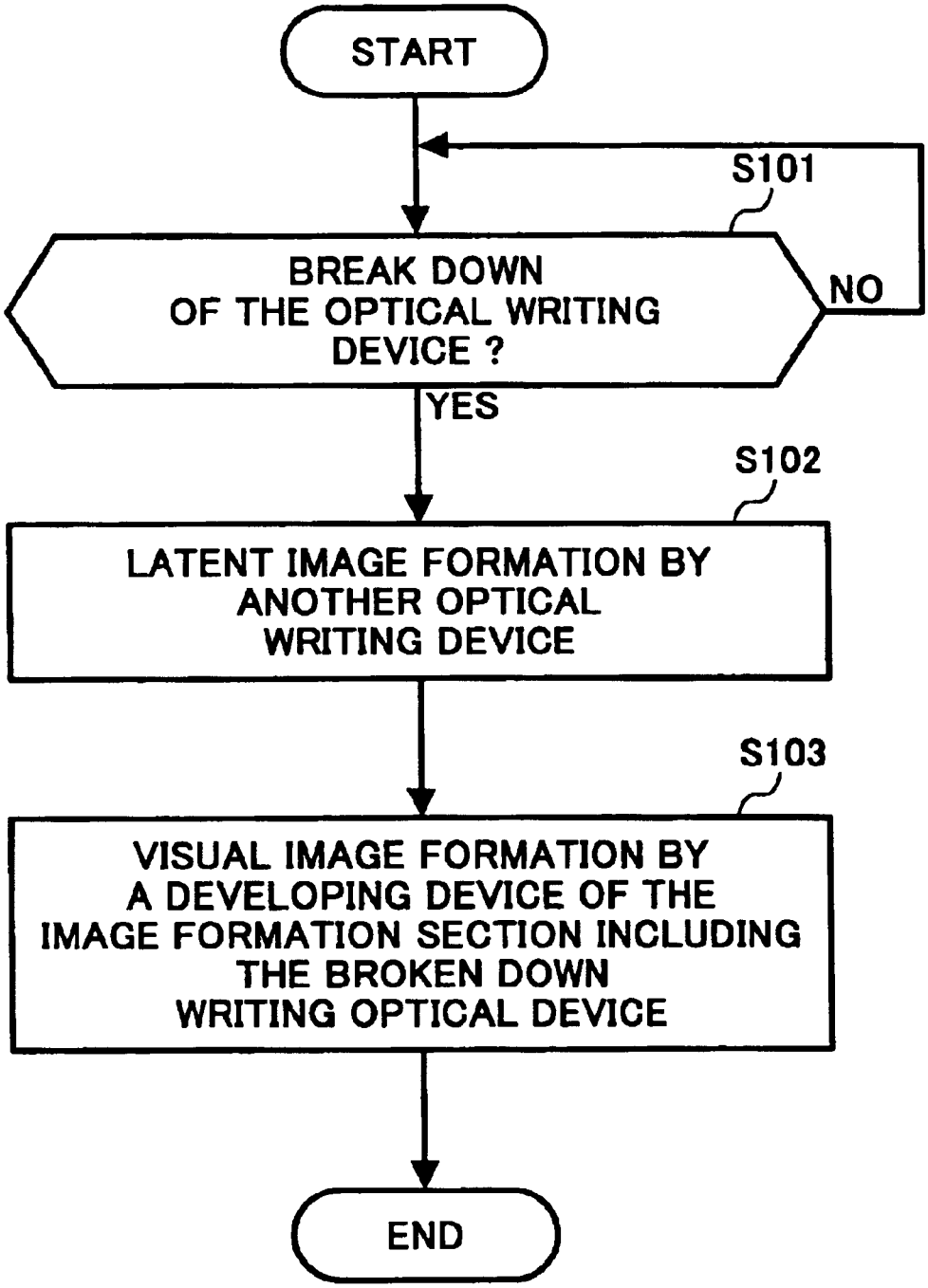
FIG. 2 is a flow chart that explains a procedure of switching the writing optical device in the case of breakdown of a writing optical device.

A switching operation of the writing optical device that propagates the image data is explained. In this embodiment, the case with the writing optical device 42, or the like of the image formation apparatus 100 broken down, of forming a latent image to be formed by the writing optical device by another writing optical device 12, or the like disposed upstream side thereof is explained. FIG. 2 is a flow chart that explains a procedure of switching the writing optical device in the case of breakdown of a writing optical device. In the image formation apparatus 100, for example, when the fourth writing optical device 42 is broken down (step S101, yes), the image forming function by the fourth writing optical device 42 cannot be used. However, at the time of forming an image without the need of using the third image formation section 53, that is, an image without the third image, the image data to be transmitted to the fourth writing optical device 42 can be transmitted to the third writing optical device 32. Then, the latent image to be formed by the fourth writing optical device 42 is formed by the third writing optical device 32 (step S102).

By forming the latent image of the fourth image on the surface to have an image formed by the third charging device 31 and the third writing optical device 32 and developing the latent images by the fourth developing device 43 so as to provide a visual image, the fourth image is formed on the surface to have an image formed (step S103). Accordingly, an image can be formed without any problem even when the writing optical device 42, or the like of the image formation apparatus 100 is broken down.

In the above-mentioned example, the image to be formed by the writing optical device on the downstream side is written by the first writing optical device 32 disposed on the upstream side when the fourth writing optical device 42, or the like disposed on the downstream side is broken down. According to the image formation apparatus 100, the first image can be formed by the following procedure even when, for example the first writing optical device 12 disposed on the upstream side is broken down.

SWITCHING EXAMPLE 2

Figure 3:
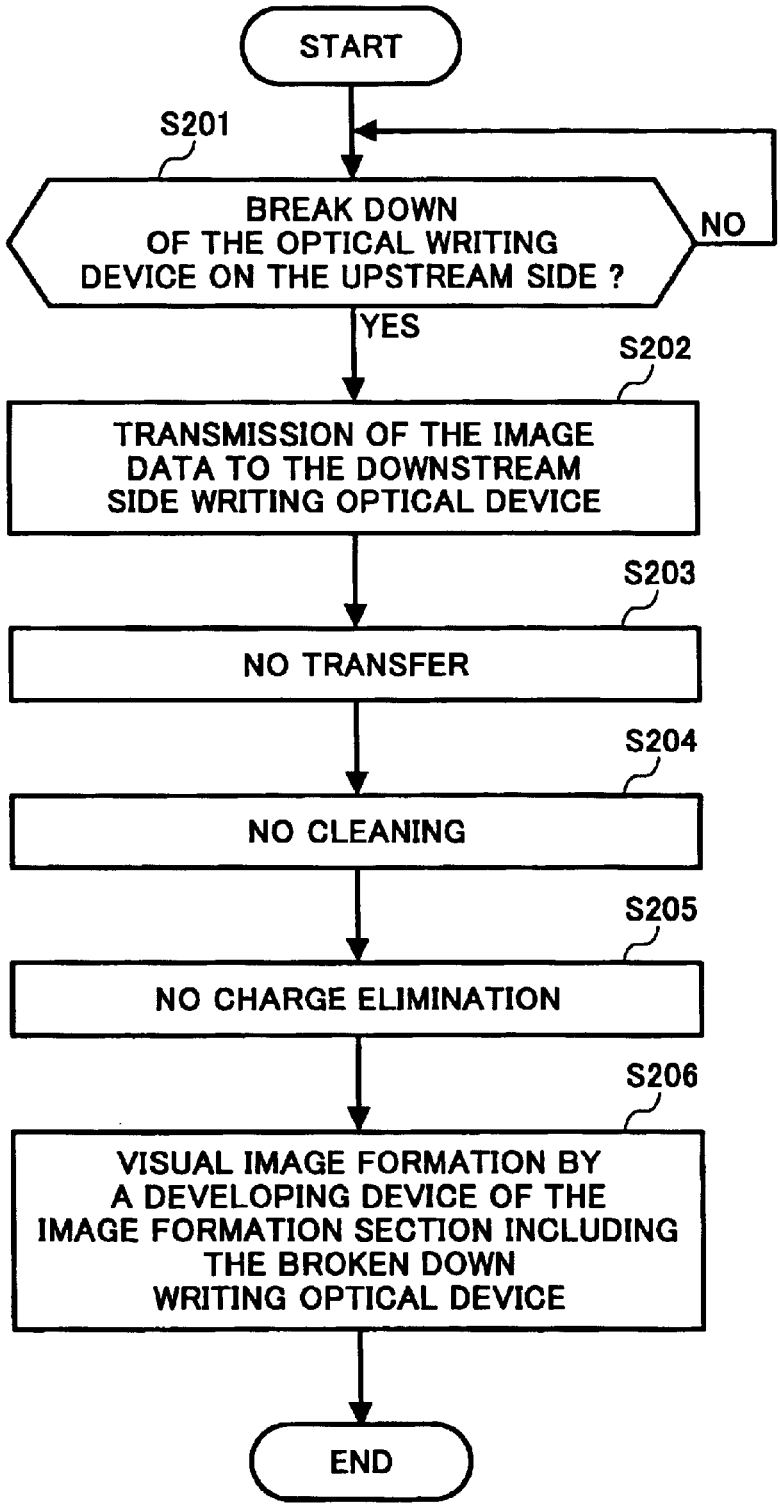
FIG. 3 is a flow chart that explains another procedure of switching the writing optical device in the case of breakdown of the upstream side writing optical device.

A switching example of the writing optical device when a writing optical device on the upstream side is broken down is explained. FIG. 3 is a flow chart that explains another procedure of switching the writing optical device in the case of breakdown of the upstream side writing optical device. For example, when the first writing optical device 12 as the uppermost stream side writing optical device is broken down (step S201, yes), first the data of the first image to be transmitted to the first writing optical device 12 are transmitted to the fourth writing optical device 42 as the downstream side writing optical device. Thereby, a latent image of the first image is formed by the fourth charging device 41 and the fourth writing optical device 42 (step S202). Next, transfer is not executed in the transfer device 2 by keeping a non-contact state (step S203). Furthermore, cleaning is not executed in the cleaning device 4 by keeping a non-contact state (step S204). And charge elimination is not executed in the charge eliminating device 5 (step S205). Thereafter, the latent image of the first image formed in the surface to have an image formed by the first developing device 13 is visualized (step S206). According to the procedure, even when the writing optical device 12, or the like disposed on the upstream side is broken down, the first image, or the like can be formed without any problem.

The image formation area to the surface to have an image formed is at most for the one turn in the moving direction of the surface to have an image formed. Since the transfer, cleaning and charge elimination steps are skipped and they are executed in the next turn, the productivity is deteriorated compared with an ordinary image formation process. Therefore, in the case of changing over the writing optical device 12, or the like to form a latent image, it is preferable to change it over to an optical system on the upstream side with respect to the developing device to form the image as well as on the downstream side with respect to the charge eliminating device 5. Thereby, an image formation apparatus can be realized without limitation of the moving direction area of the surface to have an image formed or deterioration of the productivity.

SWITCHING EXAMPLE 3

A switching example of the writing optical device according to the use frequency of a plurality of the writing optical devices is explained. A laser diode (LD), an LD array, a light emitting diode (LED) array, or the like used in the writing optical device are life parts. That is, with a higher driving current for light emission thereof, or a higher element temperature, the life thereof is shortened. Moreover, the LD is a deteriorating part to be deteriorated by use so that the light amount is lowered even with the same driving current. According to an ordinary image formation apparatus, a light receiving element for receiving a laser beam output from the LD is provided so as not to influence the image quality for feeding back the light amount of the LD. Since the function of receiving the same for increasing the current for the light amount deterioration is provided, the deterioration rate is made higher according to passage of the time.

With a higher temperature, the LD has a light amount reduced with the same driving current, and with a current increase, the temperature is raised as well. In a product, it is used so as to satisfy the product life. In the case of not reaching the product life, it is replaced regularly or optionally. Therefore, according to the image formation apparatus 100, when it is predicted that the use frequencies of the writing optical devices 12 to 42 differ, the writing optical devices 12 to 42 may be used while being switched. Thereby, since shortening of the life of only the writing optical device with a high use frequency can be prevented, the product life and the maintenance period can be prolonged.

For example, according to a color image formation apparatus comprising four colors of C, M, Y, and Bk, when the use frequency of Bk is high, the writing optical device, the developing device, or the like of Bk are disposed on the lowermost stream side. Then, by writing a Bk latent image while switching the C, M, Y or Bk writing optical device, or the like, the use frequency of the Bk writing optical device can be lowered. As a result, it can be used without shortening the life of only the Bk writing optical device with a high use frequency.

A specific method for changing over the charging device or the writing optical device that transmits the image data is explained. First, a changeover method for the charging device in the image formation apparatus 100 is explained. When the fourth image data are transmitted to the first writing optical device 12, or the like, as the charging device, the first charging device 11, or the like on the immediately upstream side of the writing optical device 12, or the like with the data transmission destination changed over can be used as well. Accordingly, when the latent image of the fourth image data is formed by another writing optical device, not only the writing optical device but also the charging device should be switched as well.

The non-contact type charging device in general comprises a corotron or scorotron method discharger and a high voltage power source for supplying a stable output to the discharger. In this case, by switching on or off the high voltage power source according to a control signal (such as a trigger signal) from the sequence control device, existence or absence of charging in the fourth or first charging device 41 or 11 can be controlled. Moreover, there is an image formation apparatus capable of adjusting the output from the sequence control part to the high voltage power source according to a reference signal (level signal) or a changeover signal (bit signal). Accordingly, by controlling the sequence control, for example, a charging operation can be carried out by the first charging device 11 instead of charging by the fourth charging device 41.

A method for changing over the writing optical device that transmits the image data is explained. The writing optical devices 12 to 42 comprises a collimate lens for shaping a laser beam output from an LD element to a parallel light beam, a cylindrical lens for shaping the light beam cross-section, a polygon mirror for scanning with the laser beam light on the surface to have an image formed, an fΘ lens for converting the equivalent angle speed into a constant velocity, and an optical system having a reflecting mirror, or the like (they are not shown). Then, by scanning with the laser light beam output from the LD element on the surface to have an image formed via the optical system, a latent image is formed on the surface to have an image formed of the photosensitive drum 1.

When a latent image is formed on the surface to have an image formed, certain pixels need to be arranged on the surface to have an image formed. Therefore, the writing optical devices 12 to 42 starts a writing operation based on a reference signal (synchronous signal) of starting the scanning operation such that the writing operation of the pixels can be started at the same position in the sub scanning direction. The synchronous signal is output when a light receiving sensor or a light receiving section (not shown) receives a laser beam output form the LD element. The above-mentioned light receiving sensor or light receiving section is disposed closely on the scanning direction upstream side of the surface to have an image formed on the photosensitive drum 1 so as not to have the influence of a optical path formed by the polygon mirror, the reflecting mirror, the collimate lens, or the like. The laser beam at the beginning of the writing operation, received by the light receiving sensor, or the like is converted into an electric signal so as to be transmitted to the LD controller as a synchronous timing.

Based on the synchronous signal, in the LD controller, the LD element is driven according to the image data for successively forming pixel latent images on the surface to have an image formed of the photosensitive drum 1. The writing optical devices 12 to 42 have a function for intentionally displacing the arrangement of the pixels for correcting the characteristics of the fΘ lens, or correcting displacement of the pixel positions derived from the fluctuation of the optical system due to the temperature change, or the like. Moreover, a system having a function of detecting a change in the optical path derived form the temperature change, or the like by providing the light receiving sensor or light receiving section in general disposed on the upstream side in the sub scanning direction also on the downstream side.

Figure 4:
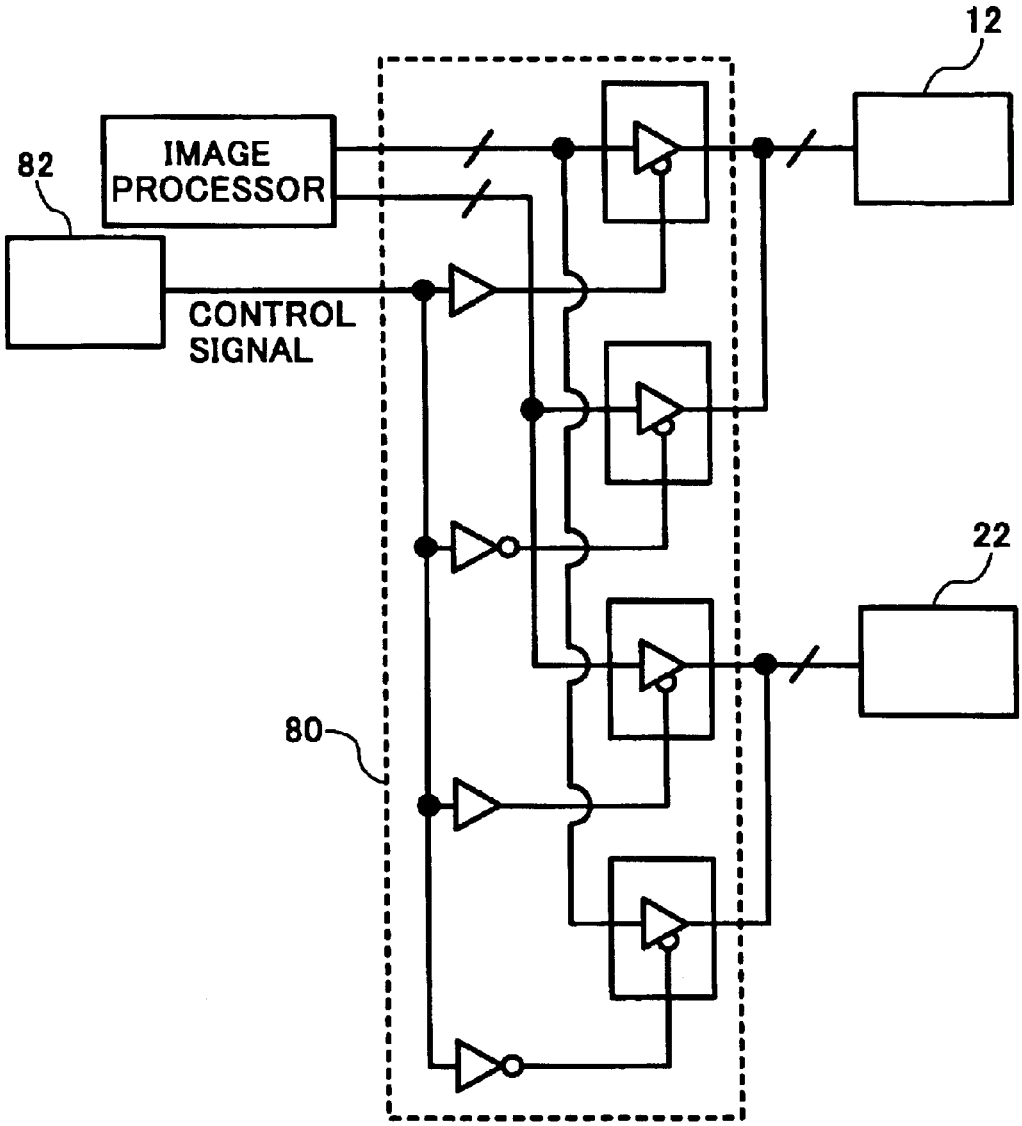
FIG. 4 shows an embodiment of a changeover section of a writing optical device.

The interface for transmitting the image data to the LD controller varies. Recently, those having a small voltage swing or those using a differential current for reducing the EMI noise are the mainstream. FIG. 4 shows an embodiment of a changeover section of a writing optical device. As shown in the figure, the image data transmission destination of a plurality of the writing optical devices 12 to 42 (here 12, 22) can be changed over by a semiconductor switch 80. Therefore, by providing a changeover function of the image data destination in the interface common part, the writing optical device that transmits the image data can be changed over by a sequence controller 82 when a certain condition is satisfied.

At the time, when a single color image is printed by transmitting the second image data to be written merely by the second writing optical device 22 to the first writing optical device 12, the writing optical device to have the image data transfer can be changed over by the sequence controller 82. However, in the case of printing a color image with a plurality of colors, displacement of the colors should be restrained to a minimum degree. In such a case, the scanning starting reference signal is obtained for synchronizing the writing starting positions in the writing optical devices 12 to 42.

Figure 5A:
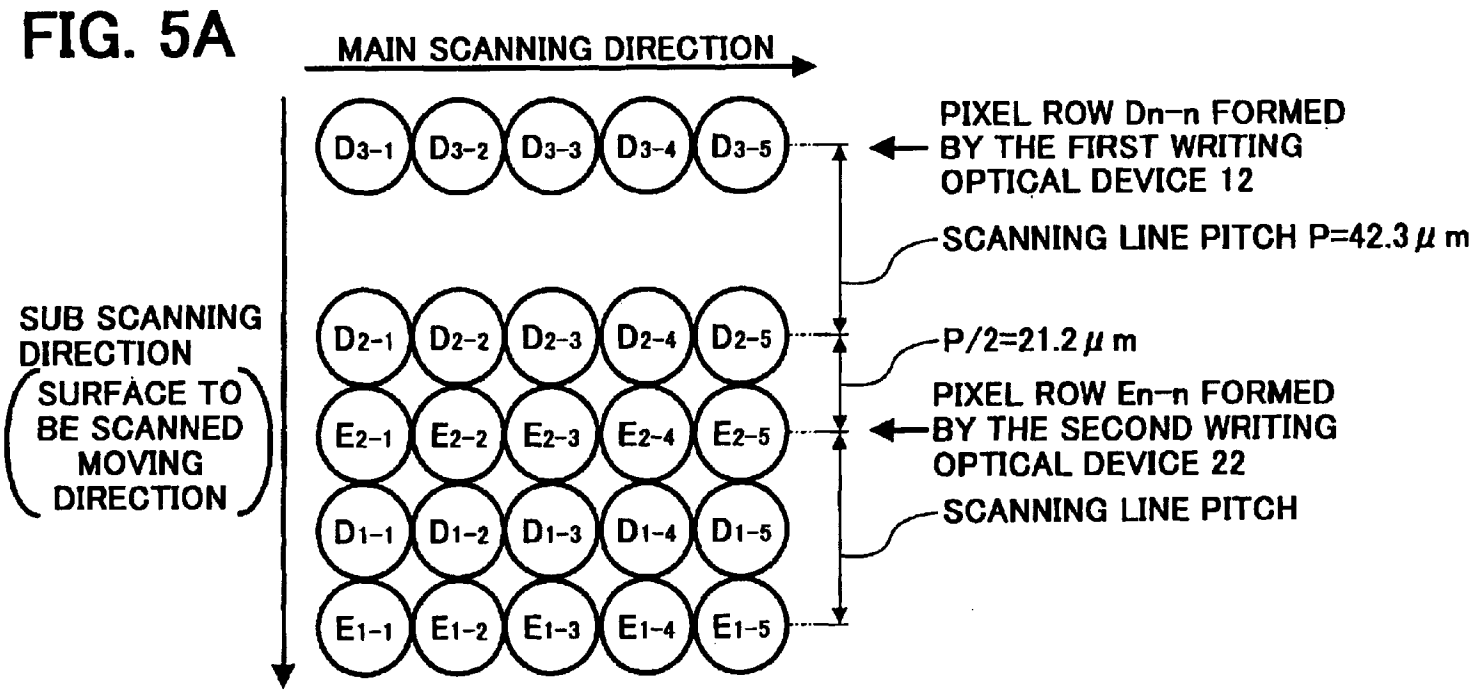
FIGS. 5A and 5B show an image formation method of an image formation apparatus according to a second embodiment of the present invention.
Figure 5B:
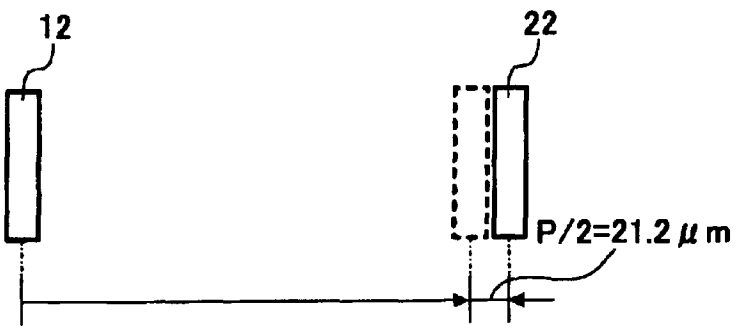
Figure 6:
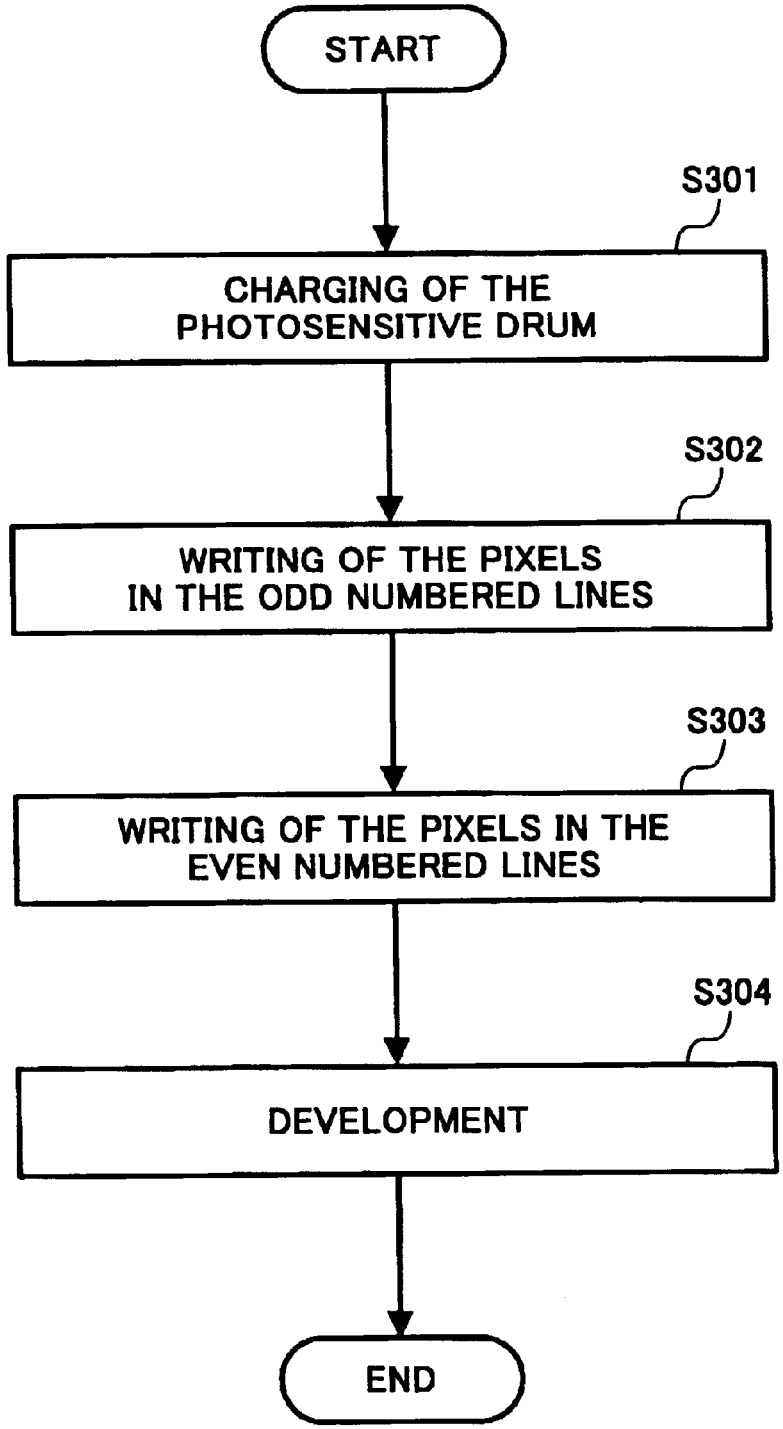
FIG. 6 is a flow chart that explains an image formation method of an image formation apparatus according to a third embodiment of the present invention.

FIGS. 5A and 5B show an image formation method of an image formation apparatus according to a second embodiment of the present invention. Moreover, FIG. 6 is a flow chart that explains an image formation method of an image formation apparatus according to a third embodiment of the present invention. It is characteristic of the image formation method that the image density in at least one of the main scanning direction and the sub scanning direction is made higher by using a plurality of the writing optical devices and controlling the writing positions thereof than that in the case of writing with a signal writing optical device. Since the other parts of the configuration are same as those of the first embodiment, explanation thereof is omitted and the same components are provided with the same numerals. The scanning direction of the writing optical device is referred to as the main scanning direction and the scanning direction perpendicular to the main scanning direction is referred to as the sub scanning direction in the description that follows.

Recently, accompanied by the improvement of the productivity and the improvement of the image quality (improvement of the writing density) of the image formation apparatus, the performance required to the writing optical system has become higher. In the LD scanning writing optical system, since the productivity and the writing density directly influence the rotation speed of the polygon mirror and the operation speed of the LD controller, various measures have been taken. The rotation speed of the polygon mirror has the upper limit according to the structure thereof. Although the rotation frequency thereof can be improved by changing from the ball bearing structure to the air bearing structure, the cost is made higher at the same time. Due to the limitation of the optical system such as the performance of the fΘ lens, and the structure of the polygon mirror, the usable area (effective image area) in the LD scanning with respect to the image line cycle is in general about 60%. Here, the line cycle represents the border of the lines at the time of linking image data for a large number of lines in the case of forming an image by arranging a large number of lines in the sub scanning direction with a row of the pixel arrangement in the main scanning direction defined to be one line.

When the line cycle on the image data is 470 $\mu$m and the image length of one line when 36 inches, the number of pixels in the one line is 21,600 pixels at the time the pixel density is 600 dpi. Therefore, the graphic cycle per one pixel is 21.8 nsec, but the cycle per one pixel in the effective image area 60% is 13.1 nS. Then, it is effective to use a system comprising a plurality of the LD elements for scanning with a plurality thereof at the same time. Thereby, the rotation speed of the polygon is made lower for the subtraction by the number of the LD elements with the same productivity and the same writing density as well as the cycle per one pixel is made lower by the same ratio. However, in order to scan with laser light beams by the LD elements at the same time, a unit for realizing the beam pitch is necessary.

The simplest configuration can be realized by using an LD array having LD elements as the light sources arranged by a 42.3 $\mu$m pitch for example when the desired beam pitch is 600 dpi. However, when the pitch cannot be realized or the image density need to be switched, the pitch in the perpendicular direction can be provided desirably by tilting the LD array in the scanning direction instead of providing the LD array perpendicularly.

In this case, since the writing starting points differ depending on the laser beam of each LD element, a function for adjusting the writing starting point for each laser beam is needed. Furthermore, there are a technique for providing a desired pitch on the surface to be scanned by emitting the laser beams of different LD elements with a slight angle instead of emitting the same parallel, or a technique of providing a desired pitch by reflecting laser beams, however, an optical system and other structures are required for realizing the same.

According to the present invention, by using a plurality of different writing optical devices of the image formation sections, the same or higher writing density or productivity with respect to the apparatus comprising the LD elements can be provided without using a writing starting position adjusting function or a pitch changing function.

A method for improving the writing density in the sub scanning direction is explained. In the description hereafter, the pixel lines and the pixels are described with the expressions of the odd numbered line, the even numbered line, the odd numbered pixels and the even numbered pixels, but they are the expressions for the explanation convenience, and the present invention is not limited thereby. An example of a system of using two writing optical devices and operating the writing optical devices by for example 600 dpi is explained. The image formation apparatus 101 comprises the first to fourth image formation sections 51 to 54 as in the image formation apparatus 100 according to the first embodiment (see FIG. 1). Then, the first to fourth writing optical devices 12, 22, 32, 42 provided therein have the same writing ability.

The photosensitive drum 1 is charged by the charging device disposed on the upstream side with respect to the writing optical device that writes the latent image (step S301). In this embodiment, since the writing optical devices 12 and 22 are used, the photosensitive drum 1 is charged by the charging device 11. Moreover, in this embodiment, at least two of the first to fourth writing optical devices 12 to 42 are used. In the following explanation, although the writing optical devices 12 and 22 are used, it is not limited to the combination.

As shown in FIG. 5B, the first writing optical device 12 and the second writing optical device 22 are displaced from the normal position by 21.2 $\mu$m in the sub scanning direction, that is, a half pitch of the pixel density (P/2). Thereby, the writing starting positions of the first writing optical device 12 and the second writing optical device 22 in the sub scanning direction are displaced by the half pitch. At the same time, the resists in the main scanning direction are adjusted such that the first and second writing optical devices 12 and 22 start the writing operation at the same position. As a result, the writing operation is executed such that the even numbered lines of the latent image formed by the second writing optical device 22 are disposed between the odd numbered lines of the latent image formed by the first writing optical device 12. It is executed by the adjusting function for superimposing the images by the two writing optical devices 12, 22.

At the time of writing, first pixels Dn-n in the odd numbered line (n is an integer of 1 or more, the same is applied hereinafter) are written by the first writing optical device 12 disposed on the upstream side (step S302). Then, pixels En-n of the even numbered line are written between the pixels Dn-n in the odd numbered line by the other writing optical device disposed on the downstream side of the writing optical device (here, the second writing optical device 22) (step S303).

Accordingly, the even numbered lines of the line 2 to the line 2*i* formed by the second writing optical device 22 are inserted between the odd numbered lines of the line 1 to the line 2*i+1* formed by the first writing optical device 12. According to the configuration, the odd numbered lines of the image data (1 to 2*i+1*, i is an integer of 1 or more) are transmitted to the first writing optical device 12, and the even numbered lines (2 to 2*i*, i is an integer of 1 or more) are transmitted to the second writing optical device 22. Then, in the first and second writing optical devices 12, 22, a latent image can be formed on the surface to have an image formed by a 1,200 dpi density in the sub scanning direction in the same state as in the case of forming ordinarily an image of 600 dpi.

Thereby, for example a latent image of a single color image of Bk, or the like is formed on the photosensitive drum 1, and the latent image is developed by the developing device disposed on the downstream side of the writing optical device that has formed the latent image (step S304). According to the configuration, the writing density in the sub scanning direction can be doubled without lowering the printing speed. Moreover, when the moving speed of the surface to have an image formed is doubled, a system capable of forming an image with a double productivity speed with a 600 dpi image density in the sub scanning direction can be provided.

At the time of writing pixels of the even numbered lines (2 to 2*i*) between the odd numbered lines (1 to 2*i+1*) using 3 or more writing optical devices, the pixels En-n of the even numbered lines may be written by a size of ⅓ or ¼ of the pixel pitch P. Thereby, the writing density in the sub scanning direction can be tripled or quadrupled. In the case of a 600 dpi image density in the sub scanning direction, by tripling or quadrupling the moving speed of the surface to have an image formed, the productivity can be improved to the three times or the four times.

In this embodiment, the two writing optical devices are displaced by half of the writing density. This is because the displacement by the half pixel in not only the same color images but also when a plurality of images are superimposed or when a plurality of images are combined can hardly be detected visually in a 600 dpi image density. However, depending on the required image quality, or in the case of forming an intermediate color is formed by a combination of different colors, a unit for adjusting the pitch in the sub scanning direction is needed.

Specifically, the writing starting position in the sub scanning direction can be adjusted by changing the angle or the position of the mirror and the lens in the optical system or the LD unit according to a feed screw method or a minute adjustment method utilizing the gear ratio and the fulcrum. At the same time, a function of transmitting the image data with the image data displaced for the writing displacement by an enlargement process of the image data and compensation of the data between the image lines is used. Moreover, in addition to the mechanical pitch adjustment in the sub scanning direction, adjustment of the writing starting position in the sub scanning direction by software can be used.

Figure 7A:
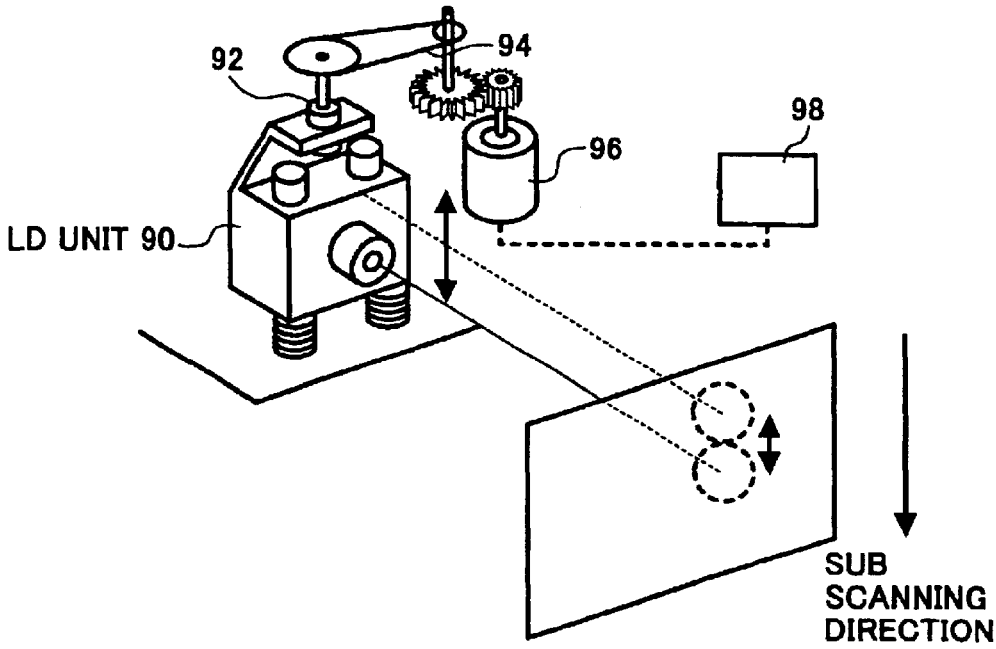
FIGS. 7A and 7B show an embodiment of a writing starting position changing mechanism.
Figure 7B:
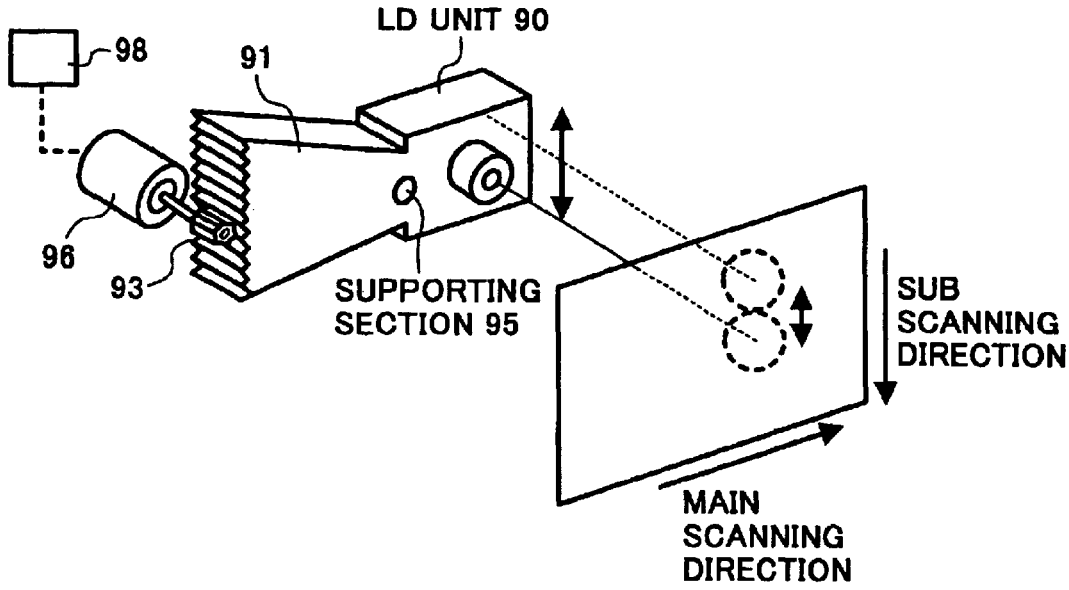

An example of a configuration for mechanically adjusting the writing starting position in the sub scanning direction is explained. FIGS. 7A and 7B show an embodiment of a writing starting position changing mechanism. FIG. 7A shows a feed screw type writing starting position changing mechanism. According to the writing starting position changing mechanism, a feed screw 92 is mounted on an LD unit 90 of the writing optical device such that the LD unit 90 is moved in the sub scanning direction by rotating the feed screw 92. The feed crew 92 is rotated by a stepping motor 96 via a belt 94. In realizing the image formation method according to the second embodiment, the stepping motor 96 is rotated by a predetermined angle by a command from a processor 98. Then, by moving the writing starting position of the LD unit 90 on the photosensitive drum 1 by P/2, the writing starting position is changed.

FIG. 7B shows a gear type writing starting position changing mechanism. According to the writing starting position changing mechanism, a gear 91 is mounted on the LD unit 90 of the writing optical device so as to be rotated around a supporting section 95. By engaging a pinion gear 93 mounted on the stepping motor 96 with a gear 91, and rotating the gear 91, the LD unit 90 is moved in the sub scanning direction. In realizing the image formation method according to the second embodiment, the stepping motor 96 is rotated by a predetermined angle by a command from the processor 98. Then, by moving the writing starting position of the LD unit 90 on the photosensitive drum 1 by P/2, the writing starting position is changed.

A method for adjusting the writing starting position in the sub scanning direction by software is explained. The image data to be transmitted to the first writing optical device 12 include a reference synchronous signal. At the time a predetermined time T passes from the synchronous signal, a writing operation of the other writing optical device 22 disposed on the downstream side is started. Here, the predetermined time T denotes the time necessary for the photosensitive drum 1 to move the distance between the writing position of the first writing optical device 12 on the upstream side and the writing position of the second writing optical device 22 on the downstream side. By starting the writing operation of the second writing optical device 22 disposed on the downstream side by a timing with the time t necessary for the photosensitive drum 1 to move for a half pitch P/2 added to the time T, the pixels En-n of the even numbered lines can be written between the odd numbered lines comprising the pixels Dn-n.

Figure 8B:
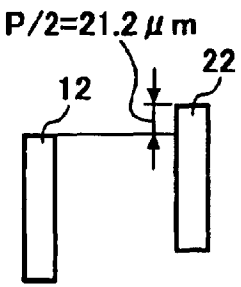
FIGS. 8A and 8B show another example of an image formation method according to the second embodiment.
Figure 8A:
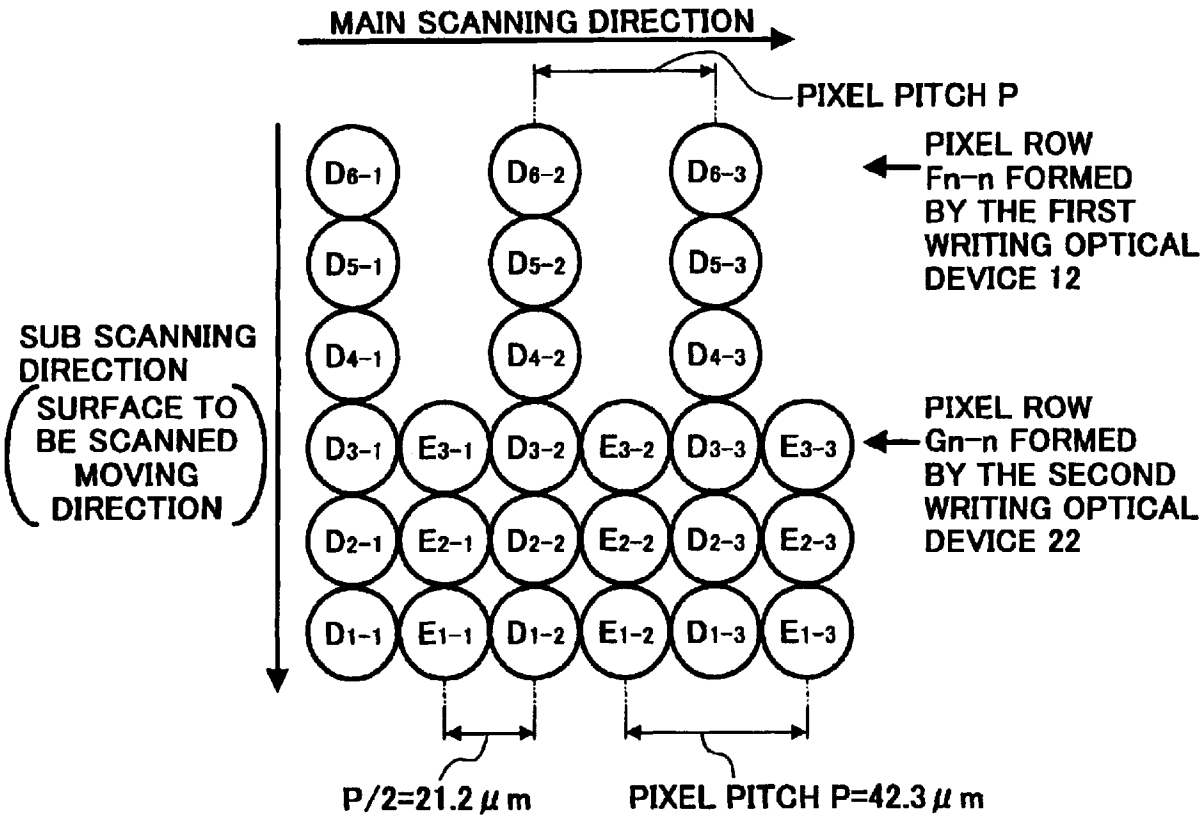
Figure 9:
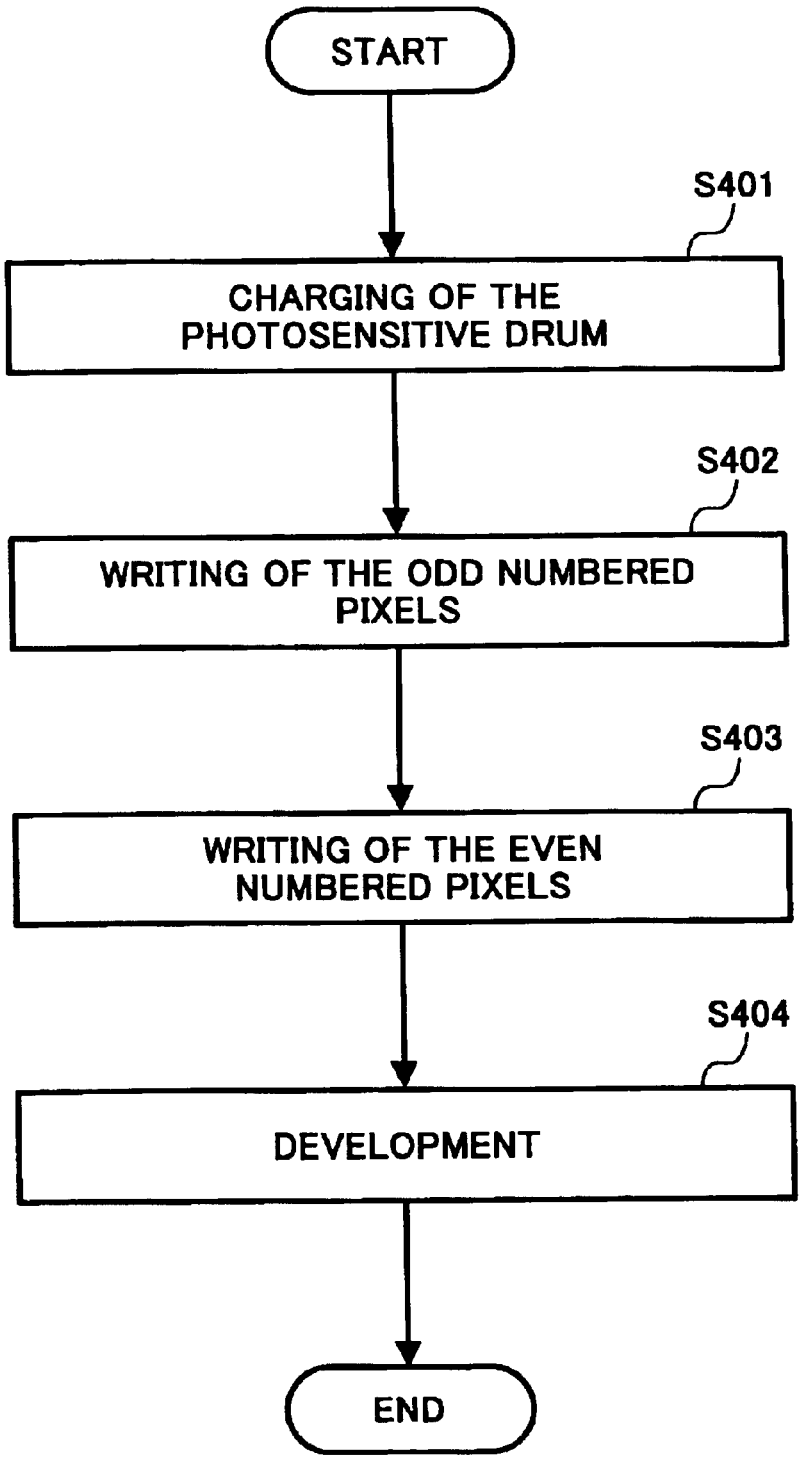
FIG. 9 is a flow chart that shows another example of an image formation method according to the second embodiment.

A method for increasing the writing density in the main scanning direction is explained. FIGS. 8A and 8B show another example of an image formation method according to the second embodiment. Moreover, FIG. 9 is a flow chart that shows another example of an image formation method according to the second embodiment.

As shown in FIG. 8B, according to the system, the first writing optical device 12 and the second writing optical device 22 are displaced in the main scanning direction by half of the pixel pitch P/2=21.2 $\mu$m. Instead thereof, the sensor or the light receiving section for producing a synchronous signal in the main scanning direction may be displaced by 21.2 $\mu$m. Further, the writing starting positions in the main scanning direction of the second writing optical device 22 may be displaced by 21.2 $\mu$m from the synchronous signal. In particular, the method for displacing the writing starting position from the synchronous signal is preferable because it can be realized easily on the software.

Thereby, the writing starting positions in the main scanning direction of the first writing optical device 12 and the second writing optical device 22 can be displaced by half of the pixel pitch P. At the same time, the resists in the sub scanning direction are adjusted such that the first and second writing optical devices 12 and 22 start the writing operation at the same position. As a result, the writing operation is executed such that the even numbered lines Gn-n of the latent image formed by the second writing optical device 22 are disposed between the odd numbered lines Fn-n of the latent image of each line formed by the first writing optical device 12. It is executed by the adjusting function for superimposing the images by the two writing optical devices 12, 22.

At the time of writing according to the image formation method, first the photosensitive drum 1 is charged by the charging device disposed on the upstream side with respect to the writing optical device that writes the latent image (step S401). Next, as shown in FIG. 8A, the odd numbered pixels Fn-n are written by the first writing optical device 12 disposed on the upstream side (step S402). Then, even numbered pixels Gn-n are written between the odd numbered pixels Dn-n by the second writing optical device 22 disposed on the downstream side of the first writing optical device 12 (step S403). At the time, the writing operation for the even numbered pixels Gn-n is started by the second writing optical device 22 from the same position in the sub scanning direction based on the synchronous signal included in the image data of the odd numbered pixels Fn-n.

At the time, the odd numbered pixels Fn-n (n=1 to $2i+1$) of each line of the image data are transmitted to the first writing optical device, and the even numbered pixels Gn-n (n=2 to $2i$) are transmitted to the second writing optical device. Thereby, in the first and second writing optical devices 12, 22, a latent image can be formed on the surface to have an image formed by a 1,200 dpi density in the main scanning direction in the state as in the case of forming ordinarily an image of 600 dpi.

Accordingly, for example a latent image of a single color image of Bk, or the like is formed on the photosensitive drum 1, and the latent image is developed by the developing device disposed on the downstream side of the writing optical device that has formed the latent image (step S404). According to the configuration, the writing density in the main scanning direction can be doubled without lowering the printing speed.

At the time of writing pixels of the even numbered lines Gn-n between the odd numbered pixels Fn-n using 3 or more writing optical devices, the even numbered pixels Gn-n may be written by a ⅓ or ¼ pitch of the pixel pitch P. Thereby, the writing density in the main scanning direction can be tripled or quadrupled.

As in the case of improving the image density in the sub scanning direction, the displacement of by the half pixel in not only the same color images but also when a plurality of images are superimposed or when a plurality of images are combined can hardly be detected visually in a 600 dpi image density. However, depending on the required image quality, or in the case of forming an intermediate color is formed by a combination of different colors, a unit for adjusting the pitch in the main scanning direction is needed.

Specifically, adjustment can be realized by changing the position of the LD unit or the sensor and the light receiving section for forming the synchronous signal according to the feed screw method or the minute adjustment method utilizing the gear ratio and the fulcrum. Or adjustment can be realized by changing the timing from the synchronous signal to start of the writing operation. The above-mentioned units can be adopted therefor.

Figure 10:
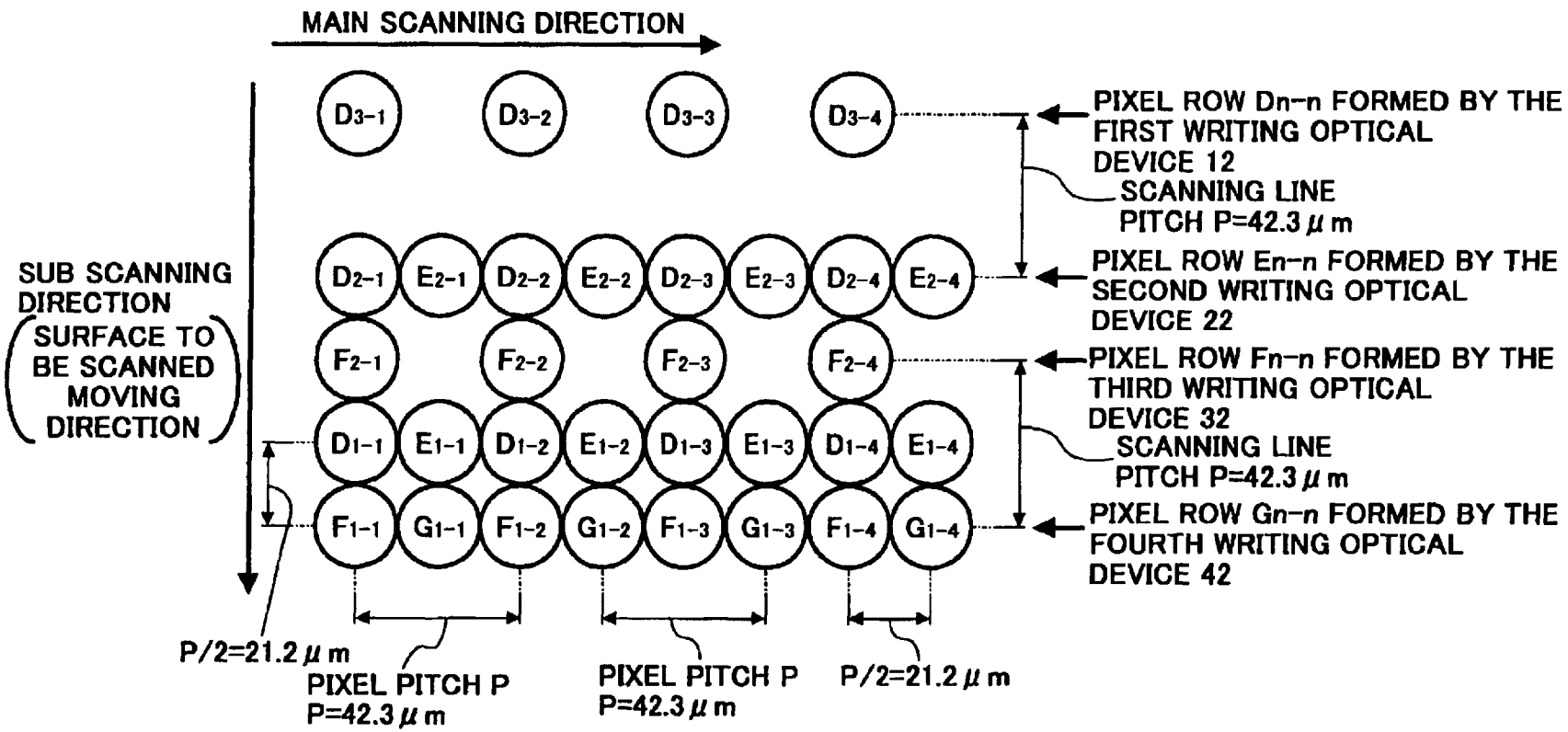
FIG. 10 is a flow chart that shows an image formation method capable of improving the image density in the sub scanning direction and the main scanning direction.

FIG. 10 is a flow chart that shows a modification in the image formation method according to the second present invention for improving the image density in the sub scanning direction and the main scanning direction. It is characteristic of the image formation method that the image density in the main scanning direction and the sub scanning direction is improved. First, the photosensitive drum 1 is charged by the first charging device 11 (step S501). The odd numbered pixels Dn-n in the odd numbered lines are written by the first writing optical device 12 (step S502). Then, even numbered pixels En-n in the odd numbered lines are written by the second writing optical device 22 (step S503). Next, the odd numbered pixels Fn-n in the even numbered lines are written by the third writing optical device 32 (step S504), and the even numbered pixels Gn-n in the even numbered lines are written by the fourth writing optical device 42 (step S505).

By developing the latent image of for example a Bk image formed on the photosensitive drum 1 by the developing device 43 (step S506), the writing density in both the main and sub scanning directions can be doubled without lowering the printing speed.

Figure 11:
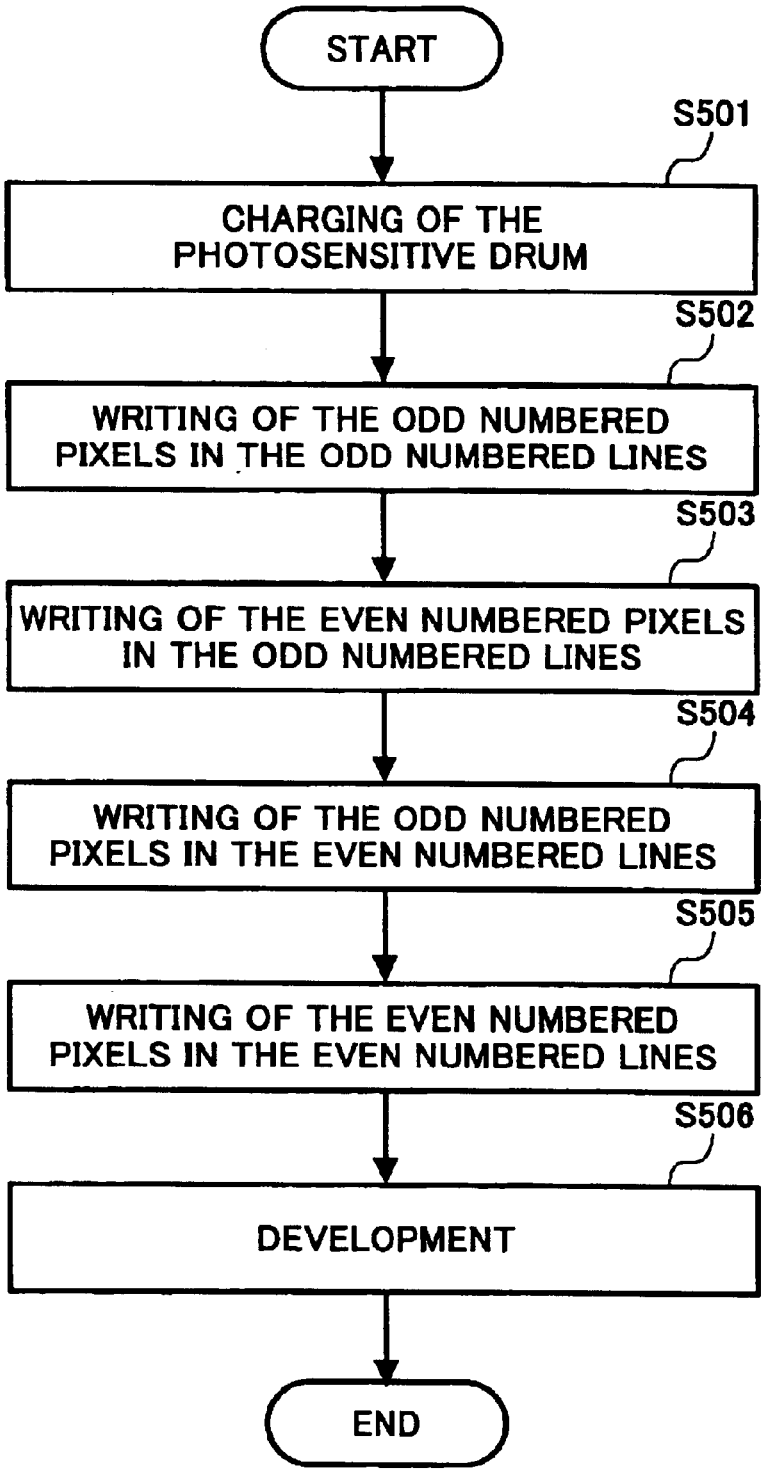
FIG. 11 shows an image formation apparatus according to a third embodiment.
Figure 12:
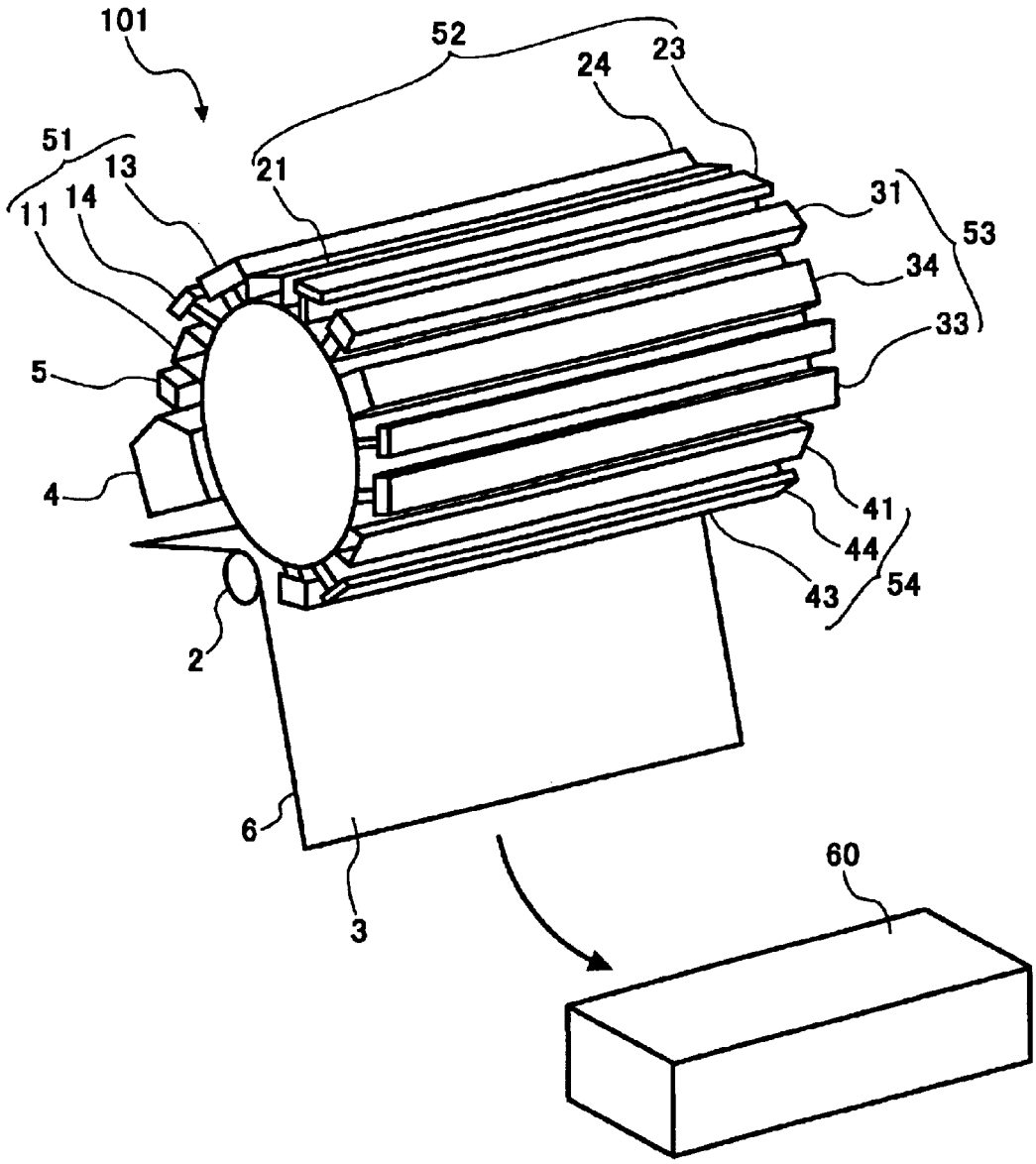
FIG. 12 shows an image formation method according to the third embodiment.

FIG. 11 is a flowchart of an image formation method according to a third embodiment and FIG. 12 shows an image formation apparatus 101 according to the third embodiment. The image formation apparatus 101 has substantially the same configuration as the image formation apparatus 100 according to the second embodiment. The two differ in that LPH 14, 24, 34, 44 are used in the writing optical devices of the image formation apparatus 101.

Whether maintenance is needed largely influences the structure of the image formation apparatus. If maintenance of the writing optical device is necessary, not only the structure capable of executing the maintenance work is required, the structure for facilitating the maintenance work is needed as well. According to a writing optical system using an LD light as a single color light, since the shielding property is required from the security viewpoint, the shielding property and the maintenance property are in the trade off relationship. In contrast, since an LPH utilizes a light emitting diode, a shielding property lower than that of the LD writing optical device is sufficient. Therefore, the LPH provides a structure advantageous for miniaturization and facilitating the mounting operation compared with the LD writing optical device.

Figure 13:
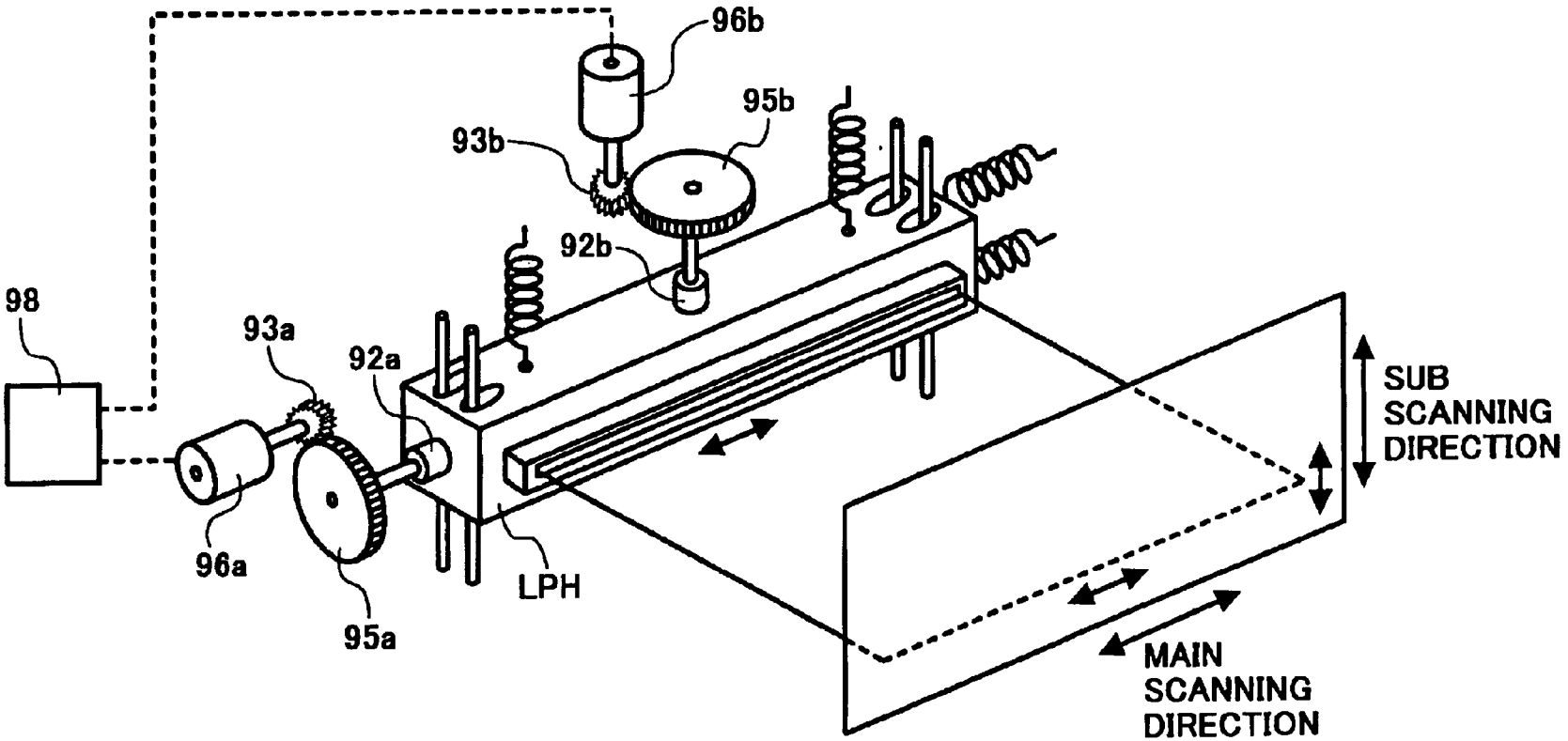
FIG. 13 shows the moving structure of a light emitting diode print head (LPH)

Since the image formation method according to the third embodiment is same as the image formation method according to the second embodiment, for the next explanation, FIG. 8A is referred to. As shown in FIG. 8A, at the time of writing, first the odd numbered pixels Fn-n are written by the LPH 14 disposed on the upstream side. Then, the even numbered pixels Gn-n are written between the odd numbered pixels Fn-n by the LPH 24 disposed on the downstream side of the writing optical device. Since the pixel pitch P of the LPH 14 to 44 is constant, it is necessary to displace the LPH 24 by a half pitch P/2 in the main scanning direction at the time of writing the even numbered pixels Gn-n by the LPH 24. FIG. 13 shows the moving structure of the LPH.

A feed screw 92*a* is mounted on the side surface of the LPH perpendicular to the LED arrangement direction (main scanning direction) such that the LPH is moved in the main scanning direction according to the rotation of the feed screw 92*a*. Moreover, a feed screw 92*b* is mounted on the side surface of the LPH perpendicular to the sub scanning direction such that the LPH is moved in the sub scanning direction according to the rotation of the feed screw 92*b*. Moreover, the feed screws 92*a*, 92*b* are mounted on stepping motors 96*a*, 96*b* as an actuator so as to be rotated via pinion gears 93*a*, 93*b* and gears 98*a*, 95*b*.

At the time of writing the even numbered pixels Gn-n between the odd numbered pixels Fn-n, the processor 98 rotates the stepping motor 96*a* by a predetermined angle corresponding to P/2. Then, since the feed screw 92*a* is rotated by the predetermined angle, the LPH is moved in the main scanning direction by P/2. Thereby, the even numbered pixels Gn-n are written between the odd numbered pixels Fn-n.

According to the configuration, a latent image of a single color image of for example Bk is formed on the photosensitive drum 1, and it is developed by a developing device disposed on the downstream side of the writing optical device that has formed the latent image. According to the configuration, the writing density in the main scanning direction can be doubled without lowering the printing speed. Moreover, as shown in the figure, the feed screw 92 and the stepping motor 96*a* can be mounted on at least one of the LPH 34, 44. Accordingly, since the even numbered pixels Gn-n can be written by a ⅓ or ¼ pitch of the pixel pitch P at the time of writing the even numbered pixels Gn-n between the odd numbered pixels Fn-n, the writing density in the main scanning direction can be tripled or quadrupled.

According to the structure thereof, the LPH writes by the equal magnification. Since the pixel density is determined by the integration degree of the LED array, the pixel density improvement leads to increase of the cost. According to the image formation apparatus 101 of the third embodiment of the present invention, by using a plurality of the LPH, a latent image of a single color image is formed by a writing density higher than that of the case of forming a latent image of a single color image by a single LPH. Thereby, a high performance image formation apparatus 101 can be provided with the writing performance improved without raising the LPH function (cost) as the writing optical device or lowering the productivity.

Figure 14:
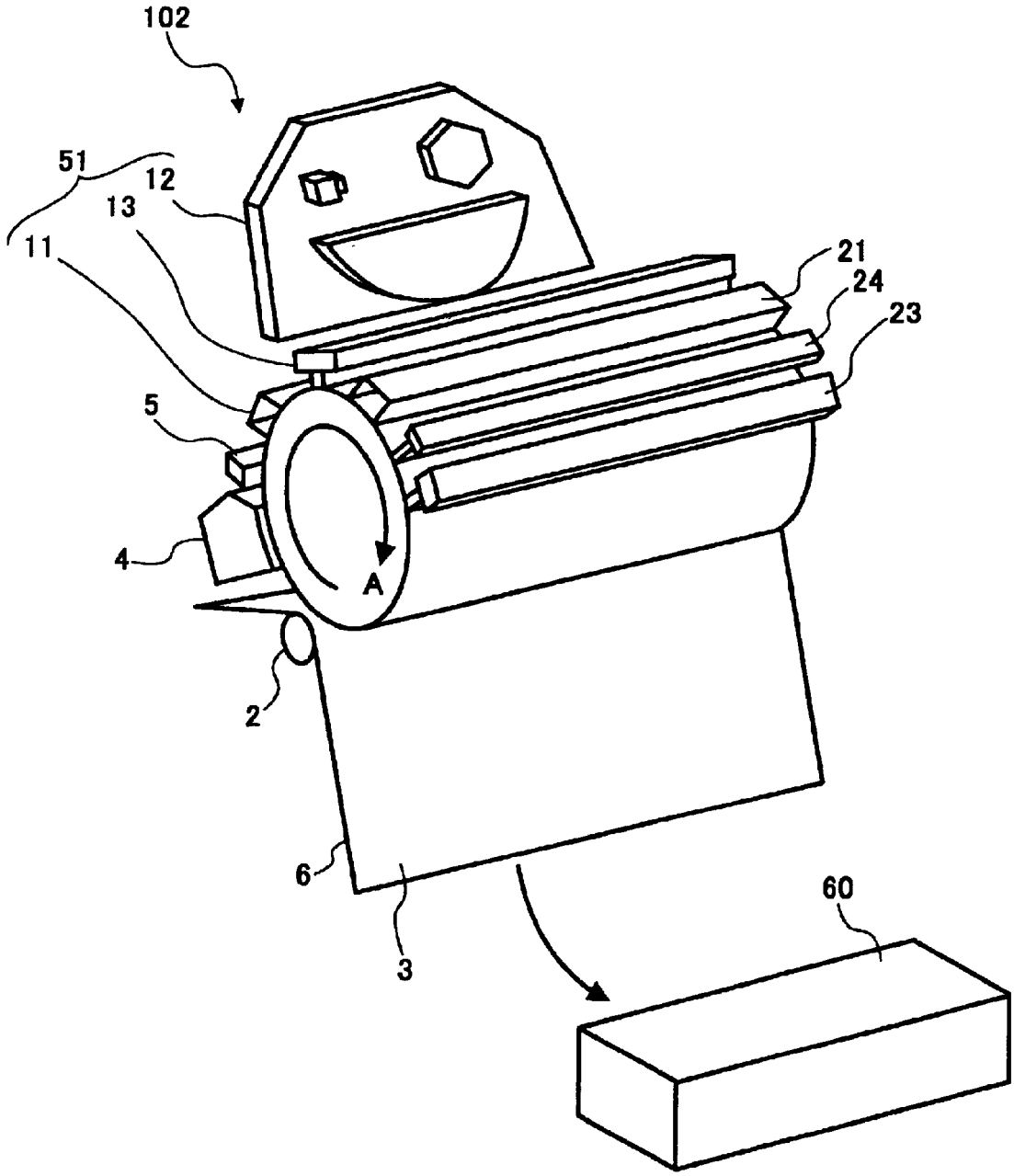
FIG. 14 is a perspective view that shows an image formation apparatus according to a fourth embodiment of the present invention.

FIG. 14 is a perspective view that shows an image formation apparatus 102 according to a fourth embodiment of the present invention. The image formation apparatus 102 comprises a plurality of image formation sections having a writing optical device and a developing device with different writing abilities. A characteristic of the image formation apparatus 102 is that when the image formation section with a high writing ability is disposed on the upstream side and forming an image by a single image formation section with a low writing ability disposed on the downstream side, a latent image is formed by the upstream side writing optical device and developing the latent image by the downstream side developing device.

According to the recent request for the miniaturization, the image formation apparatus is required to have a size as small as possible. Therefore, there are image formation apparatus using an LPH advantageous for the miniaturization compared with a laser writing optical device in a writing optical device that forms a latent image. Since the LPH has a substantially rectangular parallelepiped shape, it can be handled easily as well as it can be designed easily for the mounting space in the image formation apparatus, and thus the freedom in disposing the head can be improved.

However, improvement of the resolution of the LED array leads to the production cost increase so that in consideration of the realistic cost of the image formation apparatus, the writing ability is limited. Therefore, according to an image formation apparatus capable of forming an image of a plurality of colors, a laser writing optical device is used for a main optical writing optical device for an image, and an LPH is used for an auxiliary optical writing optical device for an image. According to the configuration, both miniaturization and a high image quality of the color mainly used can be achieved.

On the circumference of the surface to have an image formed on the photosensitive drum 1, a first charging device 11, a first writing optical device 12 and a first developing device 13 are disposed successively as a first image formation section 51 along the rotation direction of the photosensitive drum 1. As the first writing optical device 12, a laser writing optical device is used. Moreover, on the downstream side of the first developing device 13, a second charging device 21, a second writing optical device 24, and a second developing device 23 are disposed successively as a second image formation section 52. As the second writing optical device 24, an LPH is used. On the downstream side of the second developing device 23, a transfer device 2, a cleaning device 4 and a charge eliminating device 5 are disposed successively.

According to the configuration, a black (hereinafter referred to as Bk) image is formed by the first charging device 11, the first writing optical device 12, and the first developing device 13, and an image other than black (for example, magenta, hereinafter referred to as M) is formed successively by the second charging device 21, the second writing optical device 22 and the second developing device 23. When a two color image of Bk and M is formed, first a Bk image is formed on the surface to have an image formed of the photosensitive drum 1 by the first charging device 11, the first writing optical device 12 and the first developing device 13 during one rotation of the photosensitive drum 1. In addition, an M image is formed on the surface to have an image formed of the photosensitive drum 1 by the second charging device 21, the second writing optical device 24 and the second developing device 23.

The Bk and M images formed on the surface to have an image formed of the photosensitive drum 1 during the rotations are transferred onto the surface to be transferred 3 of the medium to be recorded 3 such as a paper, an OHP sheet, or the like by the transfer device 2. The medium to be recorded 3 with the Bk image and the M image transferred has the images transferred on the surface to be transferred 3 fixed by the fixing device. The surface to have an image formed of the photosensitive drum 1 after the transfer has the residual image forming material on the surface to have an image formed cleaned by the cleaning device 4, and then the residual potential eliminated by the charge eliminating device 5.

For example, according to the image formation apparatus 102, since an LD is used for the first writing optical device 12 for forming a latent image of a Bk image, the writing ability thereof is made higher than that of the second writing optical device 22 using an LPH. Here, the writing ability is represented by at least one selected from the group consisting of the gradation expressing ability of the latent image power in a pixel of the writing optical device 12, 22, the gradation expressing ability of the size in a pixel, the tightness of the pixel pitch (writing density), and the pixel position changing ability in the case of changing the pixel size. Here, the gradation expressing ability of the latent image power in a pixel of the writing optical device 12, 22 and the gradation expressing ability of the size in a pixel are referred to as the gradation expressing ability. A combination of a plurality of these elements may be referred to as the writing ability.

However, according to the configuration of the image formation apparatus 102, the printing quality of the M image is poorer than the printing quality of the Bk image, and thus when a line drawing is printed by only M, the difference of the printing qualities is conspicuous. In order to prevent this, at the time of printing an image of an M single color, the latent image thereof is formed on the surface to have an image formed of the photosensitive drum 1 by the first writing optical device 12, and the latent image is developed by the second developing device 23. Thereby, the writing ability of the first image formation section 51 for forming the Bk image can be reflected at the time of forming the M image.

In the image formation apparatus 102 comprising a plurality of image formation sections according to the present invention, by disposing a writing optical device of a high writing ability on the upstream side, a system capable of selecting the optimum image formation section can be realizes according to the combination of image formation. Thereby, a high performance image formation apparatus can be provided at a low cost.

As to the writing ability, the case of printing an M single color image using the gradation expressing ability of the writing optical device, and selecting an optical system with a high gradation expressing ability is explained. For example, the case with the first writing optical device having a gradation expressing ability of 8 gradations, and the second writing optical device having a gradation expressing ability of 2 gradations is discussed. In this case, when the second writing optical device is selected for image data of 4 gradations per a pixel, the gradation property is deteriorated, and thus the first writing optical device is selected.

The case with the first writing optical device having a gradation expressing ability of 8 gradations, and the second writing optical device having a gradation expressing ability of 4 gradations is discussed. In this case, for image data of 4 gradations per a pixel, the gradation property is not deteriorated in either case of selecting the first or second writing optical device. However, the gradation property of the image data an the gradation property of the image formed by the latent image cannot always be same because the intermediate gradation in the image data is in general different from the gradation of the image formed from the latent image. This is because the image data are read data, or they are data indicated on a display from a PC. Therefore, in general, the image data are corrected by providing a wide gradation function to the writing optical device, and preliminarily selecting the gradation of the image data corresponds to which of the gradations of the writing optical device according to the kind of the image data. This is referred to as the writing $\gamma$ correction.

In the case of an image having straight lines of a continuous pixel both vertically and laterally, although they have the same line width (corresponding to the diameter of a pixel) on the image data, the lateral lines can be developed narrower than the vertical lines for the same latent image in the developing device of the image formation section. Furthermore, the shape of the latent image of a pixel by the writing optical device is not a complete round shape and it is influenced by the structure of the light source or the lens, and thus the laser beam output from the light source is corrected in the writing optical system. Then, according to the correction, there is a correction process of narrowing the vertical lines at the time of development by changing the power per a pixel of the size for the straight line in the thickening direction.

In contrast, when an image is formed by a plurality of the image formation sections at the same time, the image data are increased in the case of a multiple color or full color image, that is, they are increased to a multiple of the number of the image formation sections by a simple calculation. Therefore, since the image processing ability and the image data transmitting ability are provided for the environment with the largest image data, not all the gradation expressing ability may be used depending on the image formations sections. Therefore, in the case of printing a single color image, a process with a higher gradation expressing ability can be enabled.

A plurality of the image formation sections comprise a writing device that optimizes the system according to the image data at the time of the simultaneous operation so as to provide the gradation function suitable for the image formation section. Therefore, depending on the size or the kind of the image, some of the image formation sections with an extra space of the image process or the transmission may not provide all the gradation expressing ability in the image formation so as to be used in a state wit an extra space for the gradation expressing ability.

An example of an image formation apparatus that forms a two color (Bk, M) image is explained. According to the image formation apparatus that forms a two color (Bk, M) image, an image of two colors including a Bk single color and an M single color can be formed. In general, since Bk is output in most cases, the LD writing optical device is used for the Bk writing optical device. For example, a gradation expressing ability of 256 gradations is provided in a 400 dpi writing density, and a Bk latent image is developed by a contact type developing device with two components of a developing material and a developing toner.

In contrast, since M is prepared often as an option, in consideration thereof, an LPH advantageous for achieving miniaturization and having a structure to be mounted easily is used. For example, a gradation expressing ability of 32 gradations is provided in a 400 dpi writing density, and an M latent image is developed by a non-contact type one component developing device. Here, the gradation number of the M writing optical device is small because of the LPH structure. The LPH is an assembly of LED. In an LPH for 17 inches, at least LED for 6,800 pixels are arranged. In order to adjust the light amount emitted by all the LED constantly, the gradation expressing ability already corrected by the gradation and usable for expressing the image data is subtracted.

According to the present invention, 256 gradations can be expressed in 400 dpi for a Bk single color and an M single color so that the gradation expressing ability can be improved compared with the conventional M single color. Thereby, at the time of forming an M single color image, since the writing $\gamma$ correction and the line narrowing process can be executed further accurately, an M single color image can be formed with an image quality higher than the conventional ones.

At the time of selecting the writing optical device according to the gradation expressing ability, it can be selected according to the mode (Bk single color or M single color) at the time of forming the image. In addition thereto, the writing optical device can be selected also by recognition of whether it is a single color image by providing color identification data (color data bit) in the image data, or recognition of whether it is a single color image by providing identification data together with image data information by providing header data at the top of the image data.

The case of selecting an optical system of a high phase ability in the case of printing an M single color image by using the phase ability of a latent image in a pixel of the writing optical device as the writing ability is explained. First, the phase ability is explained. For example, an LD writing optical device forms an image by successively arranging the pixels in the main scanning direction. In the LD writing optical device, the size of the pixels can also be controlled. The phase ability here refers to the selection ability of forming a pixel to which side of the adjacent pixels. With high phase ability, a data process effective for a dot image and an oblique line image can be provided. In order to provide the phase ability, although it is not realized only by the power modulation, it can be realized with at least the binary or more modulation in the pulse width modulation.

When the phase ability is not provided, in the case of forming a dot line of per same pixels in the main scanning direction, in general, a pixel full lighting and a pixel without lighting are repeated so that two kinds of lines of having a dot in the odd numbered pixels or having a dot in the even numbered pixels can be produced. When the phase ability is provided, furthermore, by having all the pixels half lighting and disposing the odd numbered pixels to the pixel starting direction and the even numbered pixels to the finishing direction, a pixel equivalent to a pixel full lighting can be formed at a position of changing from the even numbered pixel to the odd numbered pixel, and a state of a pixel without lighting can be formed at a point changing from the odd numbered pixel to the even numbered pixel repeatedly. Similarly, by changing the direction of forming the even numbered pixels and the odd numbered pixels to the opposite directions, another dot line can be formed, and thus the dot line expressing ability can be doubled.

When the phase ability is provided, the apparent image density can be made higher. A half pixel of a latent image formed by a 600 dpi writing optical device is defined to be a pixel of the image data. At the time, for example, in representing a binary image by data of 0-1-0-1-0 in the main scanning direction by 1,200 dpi in the main scanning direction using the phase ability, it can be represented as a rightward half pixel to a rightward half pixel to a leftward half pixel. Therefore, the writing optical device can be selected according to the information on the existence or absence of the phase in the image data or the information on the existence or absence of the phase ability in the image process (image mode information when the image process is defined per the image mode) by preliminarily providing the information on the existence or absence of the phase ability in the writing optical device in the system control.

When the information that the writing optical device has the phase ability is provided on the image formation apparatus side, data can be transmitted without the phase or with a high density for adding a phase by pattern matching in the writing optical device, or for executing an apparently high density printing operation. Thereby, even when without the phase data, the phase can be provided or a high density printing operation can be executed.

Again, an image formation apparatus that forms a two color (Bk, M) image is explained. The image formation apparatus can form a two color image of a Bk single color and an M single color. As mentioned above, since the Bk output in general accounts for the most of that, an LD writing optical device is used for the Bk writing optical device. Then, in consideration of the fact that M is prepared as an option, an LPH writing optical device advantageous for miniaturization, to be mounted easily is used. Since the LPH has LED arranged in the main scanning direction, in order to provide a phase in the main scanning direction, at least a double density is needed. Moreover, it is theoretically possible to provide a phase in the sub scanning direction, however, in the case of realizing a phase or a high density by pattern matching, a memory of at least one line is needed.

According to the present invention, even in the case of forming a single color image with a writing optical device without having a phase ability or hardly provided with a phase ability, the image expressing ability can be improved by the phase ability by transmitting the image data to a writing optical device having a phase ability, and developing with a developing device corresponding to the image data. Moreover, even when image data are transmitted without a phase or with a high density, a phase can be provided or a high density printing operation can be executed by transmitting the image data to a writing optical device having the phase ability.

The case of selecting an optical system having a high pixel density in the case of printing an M single color image using a pixel density of a latent image in a pixel of a writing optical device as the writing ability is explained. The writing density in the main scanning direction can be changed by changing the LD driving frequency in the LD writing optical device. Moreover, the writing density in the sub scanning direction can be changed by changing the rotation speed of the polygon mirror or changing the moving speed of the photosensitive drum 1 in the surface to be scanned. However, since a high productivity is required nowadays, a system for scanning a plurality of LD at the same time is the mainstream so that the pitch of the plurality of the beams needs to be changed by the pixel density. For example, when 600 dpi and 400 dpi are switched, the pixel pitch is switched from 42.3 $\mu$m to 63.5 $\mu$m. There is a system of realizing any writing density by an intermediate pitch with little influence such as 52.9 $\mu$m.

In the case the pixel density of the image formation apparatus is not changed despite the image density data are changed, an image with pixel pitch irregularity is provided. Since the image density data differ depending on the image data from the PC or the image data from the facsimile, it is necessary to have an image density corresponding to the image data in the image formation apparatus. Although a large number of image densities can be dealt with in either the main or sub scanning direction in the LD writing optical device, change of the image density is not easy in the LPH main scanning direction due to its structure. For example, in the case of an LPH comprising 1,200 dpi, the pixel densities of 600 dpi, 400 dpi, 300 dpi, 200 dpi and 100 dpi can be dealt with, but in the case of an LPH of a 600 dpi pixel density, a 400 dpi pixel density cannot be expressed.

Accordingly, when the pixel density cannot be changed by the writing optical device, there is a method of converting the pixel density according to the writing optical device by thinning or compensating the image data by the image process. However, the productivity differs between the system of converting the density in the image process and the system without the conversion so that the productivity difference is enlarged according to increase of the image data. For example, conventionally, the image productivity at the time of 400 dpi is poorer than the image productivity at the time of 300 dpi depending on the image formation apparatus so that a phenomenon hardly understandable by the user side can be generated.

As to the image formation apparatus that forms a two color (Bk, M) image, an LD writing optical device having for example the gradation expressing ability of 256 gradations at a 400 dpi writing density is used for the Bk writing optical device. Then, in consideration of the fact the M is prepared as an option, an LPH advantageous for miniaturization, having a structure to be mounted easily is used. The LPH writing density is for example the gradation expressing ability of 32 gradations at 400 dpi.

In the case of such an image formation apparatus, at the time of printing image data of 300 dpi in a conventional image formation method, since the LD writing optical device is used for a Bk single color, the image density is changed by the writing optical device. Then, since 400 dpi cannot be changed to 300 dpi by the writing optical device for the M single color, the image density is changed by the image process. As a result, the productivity at the time of 300 dpi printing in the case of the M single color is poorer than that of the case of the Bk single color. According to the present invention, since the image density can be changed by the writing optical device at the time of printing a Bk single color or an M single color by changing the writing optical device, the same productivity can be provided to both the Bk single color and the M single color.

The image formation methods according to the first to third embodiments of the present invention can be realized by executing a preliminarily prepared program in a personal computer or a computer in a work station. The program can be distributed through a network such as the internet. Moreover, the program can also be executed by recording in a computer readable recording medium such as a hard disc, a flexible disc (FD), a CD-ROM, an MO, and a DVD, and reading from the recording medium by a computer.

As heretofore explained, according to the present invention, a latent image formed by a writing optical device in an image formation section is processed to be a visual image by a developing device of an image formation section different from the image formation section including the writing optical device that has formed the latent image. Thereby, an image formation section in a pause can be utilized effectively in a concurrent processing system.

When a writing optical device included in an image formation section is broken down, a latent image to be formed by the broken down writing optical device is formed by another unused writing optical device, and a visual image of the latent image is formed by a developing device of the image formation section including the broken down writing optical device. Thereby, since a printing operation is enabled before the broken down writing optical device is repaired, the pause period of the image formation device can be shortened in the concurrent processing system.

A latent image to be formed by a writing optical device of the low writing ability is formed by a writing optical device of the high writing ability, and a visual image of the latent image is formed by a developing device of the image formation section including the writing optical device of the low writing ability. Thereby, since a latent image can be formed by the writing optical device of the high writing ability in the case of forming a single color image, the image forming ability of the single color image can be improved in the concurrent processing system.

The present document incorporates by reference the entire contents of Japanese priority documents, 2002-017485 filed in Japan on Jan. 25, 2002 and 2003-015079 filed in Japan on Jan. 23, 2003.

Although the invention has been described with respect to a specific embodiment for a complete and clear disclosure, the appended claims are not to be thus limited but are to be construed as embodying claims are not to be thus limited but are to be construed as embodying all modifications and alternative constructions that may occur to one skilled in the art which fairly fall within the basic teaching herein set forth.

What is claimed is:

1. An image formation apparatus comprising:

a photosensitive member;

a charging device that charges the photosensitive member;

a charge eliminating device that eliminates a residual charge from the photosensitive member before the charging device charges the photosensitive member; and a first image formation section and a second image formation section each of the first image formation section and the second image formation section having a writing optical device that forms a latent image on a surface of the photosensitive member, and a developing device that forms a visual image by adhering a developing agent on the latent image, wherein a latent image formed by the writing optical device of the first image formation section is processed to be a visual image by the developing device of the second image formation section.

2. The image formation apparatus according to claim 1, wherein if the writing optical device in the first image formation section is broken down, then the latent image is formed by the writing optical device in the second image formation section, and a visual image of the latent image is formed by the developing device of the first image formation section.

3. The image formation apparatus according to claim 1, wherein if a gradation expressing ability of the writing optical device of the first image formation section is lower than a gradation expressing ability of the writing optical device of the second image formation section, then the latent image is formed by a writing optical device of the second image formation section, and a visual image of the latent image is formed by the developing device of the first image formation section.

4. The image formation apparatus according to claim 1, wherein if a phase ability of the writing optical device of the first image formation section is lower than the gradation expressing ability of the writing optical device of the second image formation section, then the latent image is formed by the writing optical device of the second image formation section, and a visual image of the latent image is formed by the developing device of the first image formation section.

5. The image formation apparatus according to claim 1, wherein if a resolution of the writing optical device of the first image formation section is lower than the gradation expressing ability of the writing optical device of the second image formation section, then the latent image is formed by the writing optical device of the second image formation section, and a visual image of the latent image is formed by the developing device of the first image formation section.

6. The image formation apparatus according to claim 1, wherein in each of the first image formation section and the second image formation section, the writing optical device is disposed on an upstream side of the developing device and on a downstream side of the charge eliminating device.

7. The image formation apparatus according to claim 1, wherein the writing optical device in any one of the first image formation section and the second image formation section is a light emitting diode array printer head.

8. An image formation apparatus comprising:

a photosensitive member;

a charging device that charges the photosensitive member;

a charge eliminating device that eliminates a residual charge from the photosensitive member before the charging device charges the photosensitive member; and a first image formation section and a second image formation section each of the first image formation section and the second image formation section having a writing optical device that forms a latent image on a surface of the photosensitive member, and a developing device that forms a visual image by adhering a developing agent on the latent image, wherein a first latent image of a first set of pixels is formed by the writing optical device of the first image formation section in a main scanning direction, a second latent image of a second set of pixels is formed between the pixels of the first set of pixels by the writing optical device of the second image formation section, and a visual image of the first latent image and the second latent image is formed by the developing device provided in one of the first image formation section and the second image formation section.

9. The image formation apparatus according to claim 8, wherein in each of the first image formation section and the second image formation section, the writing optical device is disposed on an upstream side of the developing device and on a downstream side of the charge eliminating device.

10. The image formation apparatus according to claim 8, wherein the writing optical device in any one of the first image formation section and the second image formation section is a light emitting diode array printer head.

11. An image formation apparatus comprising:

a photosensitive member;

a charging device that charges the photosensitive member;

a charge eliminating device that eliminates a residual charge from the photosensitive member before the charging device charges the photosensitive member; and a first image formation section and a second image formation section each of the first image formation section and the second image formation section having a writing optical device that forms a latent image on a surface of the photosensitive member, and a developing device that forms a visual image by adhering a developing agent on the latent image, wherein a latent image of different pixels lines in a main scanning direction is formed at different positions in a sub scanning direction by the writing optical devices of each of the first image formation section and the second image formation section on a surface of the photosensitive member, and a visual image of the latent images is formed by the developing device provided in one of the first image formation section and the second image formation section.

12. The image formation apparatus according to claim 11, wherein the writing optical device of the first image formation section forms the latent image of a first set of pixels and the writing optical device of the second image formation section forms the latent image of a second set of pixels between the pixels of the first set of pixels.

13. The image formation apparatus according to claim 11, wherein in each of the first image formation section and the second image formation section, the writing optical device is disposed on an upstream side of the developing device and on a downstream side of the charge eliminating device.

14. The image formation apparatus according to claim 11, wherein the writing optical device in any one of the first image formation section and the second image formation section is a light emitting diode array printer head.

15. An image formation method of forming an image by an image formation apparatus, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image, the method comprising:

forming a latent image by the writing optical device of the first image formation sections; and forming a visual image of the latent image by the developing device of the second image formation section.

16. An image formation method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image, the method comprising:

judging whether the writing optical device in the first image formation section is broken down;

forming the latent image by the writing optical device of the second image formation section when it is judged that in the first image formation section is broken down; and forming the visual image of the latent image by the developing device of the first image formation section.

17. An image formation method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image, wherein a gradation expressing ability of the writing optical device of the first image formation section is lower than a gradation expressing ability of the writing optical device of the second image formation section, the method comprising:

forming the latent image by the writing optical device of the second image formation section; and forming the visual image of the latent image by the developing device of the first image formation section.

18. An image formation method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image, the method comprising:

forming a first latent image of a first set of pixels by the writing optical device of the first image formation section in a main scanning direction;

forming a second latent image of a second set of pixels between the pixels of the first set of pixels by the writing optical device of the second image formation section; and forming a visual image of the first latent image and the second latent image by the developing device provided in any one of the first image formation section and the second image formation section.

19. An image formation method of forming an image by an image formation apparatus, the image formation apparatus having a first image formation section and a second image formation section each of the first image formation section and the second image formation section having a writing optical device that forms a latent image on a surface of the photosensitive member, and a developing device that forms a visual image by adhering a developing agent on the latent image, the method comprising:

forming a latent image of different pixels lines in a main scanning direction at different positions in a sub scanning direction by the writing optical devices of each of the first image formation section and the second image formation section on a surface of the photosensitive member; and forming a visual image of the latent images by the developing device provided in any one of the first image formation section and the second image formation section.

20. A program storing medium storing a computer-readable program which when executed by a computer makes an image information apparatus form an image, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image, the computer using the computer program to make the image formation apparatus perform the steps of:

forming a latent image by the writing optical device of the first image formation sections; and forming a visual image of the latent image by the developing device of the second image formation section.

21. A program storing medium storing a computer-readable program which when executed by a computer makes an image information apparatus form an image, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image, the computer using the computer program to make the image formation apparatus perform the steps of:

judging whether the writing optical device in the first image formation section is broken down;

forming the latent image by the writing optical device of the second image formation section when it is judged that in the first image formation section is broken down; and forming the visual image of the latent image by the developing device of the first image formation section.

22. A program storing medium storing a computer-readable program which when executed by a computer makes an image information apparatus form an image, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image, wherein a gradation expressing ability of the writing optical device of the first image formation section is lower than a gradation expressing ability of the writing optical device of the second image formation section, the computer program to make the image formation apparatus perform the steps of:

forming the latent image by the writing optical device of the second image formation section; and forming the visual image of the latent image by the developing device of the first image formation section.

23. A program storing medium storing a computer-readable program which when executed by a computer makes an image information apparatus form an image, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image, the computer using the computer program to make the image formation apparatus perform the steps of:

forming a first latent image of a first set of pixels by the writing optical device of the first image formation section in a main scanning direction;

forming a second latent image of a second set of pixels between the pixels of the first set of pixels by the writing optical device of the second image formation section; and forming a visual image of the first latent image and the second latent image by the developing device provided in any one of the first image formation section and the second image formation section.

24. A program storing medium storing a computer-readable program which when executed by a computer makes an image information apparatus form an image, the image formation apparatus having a first image formation section and a second image formation section, each of the first image formation section and the second image formation section having a writing optical device that forms a latent image on a surface of the photosensitive member, and a developing device that forms a visual image by adhering a developing agent on the latent image, the computer using the computer program to make the image formation apparatus perform the steps of:

forming a latent image of different pixels lines in a main scanning direction at different positions in a sub scanning direction by the writing optical devices of each of the first image formation section and the second image formation section on a surface of the photosensitive member; and forming a visual image of the latent images by the developing device provided in any one of the first image formation section and the second image formation section.

* * * * *